US012235013B2

(12) United States Patent
Gray

(10) Patent No.: US 12,235,013 B2
(45) Date of Patent: Feb. 25, 2025

(54) ADJUSTABLE BRACKET FOR WINDOW AIR CONDITIONER

(71) Applicant: Midea Group Co., Ltd., Foshan (CN)

(72) Inventor: Joel M. Gray, Prospect, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 18/067,005

(22) Filed: Dec. 15, 2022

(65) Prior Publication Data

US 2024/0200825 A1 Jun. 20, 2024

(51) Int. Cl.
*F24F 13/32* (2006.01)

(52) U.S. Cl.
CPC ..... *F24F 13/32* (2013.01); *F24F 2221/20* (2013.01)

(58) Field of Classification Search
CPC ..... F24F 13/32; F24F 1/027; F24F 1/0003; F24F 2221/20; E06B 7/03; E06B 7/28
See application file for complete search history.

(56) References Cited

U.S. PATENT DOCUMENTS

| | | | | |
|---|---|---|---|---|
| 2,320,436 A | | 6/1943 | Hull | |
| 2,433,104 A | * | 12/1947 | Eberhart | F24F 1/04 454/203 |
| 3,296,820 A | | 1/1967 | Bauman | |
| 3,309,889 A | | 3/1967 | Copp | |
| 3,372,557 A | | 3/1968 | Dyas et al. | |
| 3,394,910 A | | 7/1968 | Ulich | |
| 3,415,074 A | | 12/1968 | Metcalfe | |
| 3,491,549 A | | 1/1970 | Oglesby | |
| 3,554,476 A | | 1/1971 | Gaylor | |
| 3,576,114 A | | 4/1971 | Sharp et al. | |
| 4,079,813 A | | 3/1978 | Ellison | |
| 4,729,540 A | | 3/1988 | Rozema | |
| 5,027,614 A | | 7/1991 | Mori | |

(Continued)

FOREIGN PATENT DOCUMENTS

| | | |
|---|---|---|
| CN | 2560895 Y | 7/2003 |
| CN | 101876466 A | 11/2010 |

(Continued)

OTHER PUBLICATIONS

Guan, Guang H., United States Patent and Trademark Office, Office Action issued in U.S. Appl. No. 17/566,438, 93 pages, dated Oct. 5, 2023.

(Continued)

*Primary Examiner* — Eret C McNichols
(74) *Attorney, Agent, or Firm* — Gray Ice Higdon

(57) ABSTRACT

An adjustable bracket for a window air conditioning unit includes a base, an indoor portion, and an outdoor portion. The indoor portion is slidably received within an indoor portion of the base. The outdoor portion is optionally slidably received within an outdoor portion of the base. The indoor portion is optionally adjustable with respect to the base by way of ratchet teeth and pawl engagement or by way of first and second locking cams. The outdoor portion is optionally adjustable with respect to the base by way of ratchet teeth and pawl engagement or by way of multiple fastener openings to receive a pin or a fastener. The adjustability of the indoor and outdoor portions facilitates securely placing the bracket on a window sill.

15 Claims, 26 Drawing Sheets

(56) References Cited

U.S. PATENT DOCUMENTS

| | | | | |
|---|---|---|---|---|
| 5,035,116 | A | 7/1991 | Main | |
| 5,167,131 | A * | 12/1992 | Karkhanis | F24F 1/027 62/262 |
| 5,191,770 | A * | 3/1993 | Kim | F24F 1/32 62/263 |
| 5,582,025 | A | 12/1996 | Dubin et al. | |
| 5,823,289 | A * | 10/1998 | Csomos | A47L 3/02 182/62 |
| 6,481,228 | B1 | 11/2002 | Chiang | |
| 6,568,201 | B1 | 5/2003 | Cur et al. | |
| 6,767,278 | B1 | 7/2004 | Peterson | |
| 7,296,424 | B2 | 11/2007 | Thompson | |
| 7,383,923 | B2 | 6/2008 | Patten et al. | |
| 8,167,260 | B2 | 5/2012 | Boccia | |
| 8,533,955 | B2 | 9/2013 | Agnihotri | |
| 8,584,998 | B1 | 11/2013 | Peterson | |
| 8,925,176 | B2 | 1/2015 | Choi et al. | |
| 9,163,854 | B2 | 10/2015 | Arbucci | |
| 9,222,684 | B2 | 12/2015 | Cho et al. | |
| 9,303,895 | B1 * | 4/2016 | Grant | F24F 13/32 |
| 9,447,916 | B2 | 9/2016 | Darby | |
| D782,289 | S | 3/2017 | Darby | |
| 9,915,394 | B2 | 3/2018 | Chen | |
| 9,938,044 | B2 | 4/2018 | Gamboa | |
| 10,203,130 | B2 | 2/2019 | Gardikis, Sr. | |
| 10,295,221 | B2 | 5/2019 | Zhang | |
| 10,401,043 | B2 | 9/2019 | Li | |
| D884,461 | S | 5/2020 | Allen | |
| 10,739,018 | B2 | 8/2020 | Baumann et al. | |
| 10,760,795 | B2 | 9/2020 | Booten et al. | |
| 10,775,054 | B2 | 9/2020 | Bradford et al. | |
| 10,907,810 | B1 | 2/2021 | Moghal et al. | |
| 11,125,479 | B1 | 9/2021 | Ingram | |
| 11,168,920 | B1 | 11/2021 | Leezer et al. | |
| 11,339,993 | B2 | 5/2022 | Zhao | |
| 11,384,945 | B2 * | 7/2022 | Aryeh | F24F 13/20 |
| 11,397,023 | B2 * | 7/2022 | Xing | F24F 1/62 |
| 11,397,024 | B2 | 7/2022 | Xing | |
| 11,411,527 | B2 | 8/2022 | Simon | |
| 11,415,329 | B2 * | 8/2022 | Liu | F24F 13/32 |
| 11,441,791 | B2 * | 9/2022 | Lei | F24F 13/32 |
| 11,441,792 | B2 * | 9/2022 | Liang | F24F 1/027 |
| 11,498,163 | B2 | 11/2022 | Li et al. | |
| 11,536,469 | B2 * | 12/2022 | Si | F24F 1/027 |
| 11,566,815 | B2 | 1/2023 | Martinez Galvan | |
| 11,619,241 | B2 * | 4/2023 | Servies | F24F 7/007 248/675 |
| 11,835,172 | B2 * | 12/2023 | Dunn | F16M 11/36 |
| 2009/0031744 | A1 | 2/2009 | D'Souza | |
| 2009/0107162 | A1 | 4/2009 | Su et al. | |
| 2009/0188174 | A1 * | 7/2009 | Schreiber | E04G 21/3261 24/457 |
| 2015/0192309 | A1 | 7/2015 | Frolov | |
| 2016/0131404 | A1 | 5/2016 | Mochizuki et al. | |
| 2017/0284683 | A1 | 10/2017 | Gallo | |
| 2019/0056143 | A1 * | 2/2019 | Zhang | F24F 13/32 |
| 2019/0063760 | A1 | 2/2019 | Li | |
| 2019/0301668 | A1 | 10/2019 | Mai | |
| 2020/0124296 | A1 * | 4/2020 | Baumann | F24F 1/027 |
| 2020/0217521 | A1 | 7/2020 | Lundstrom | |
| 2020/0370764 | A1 | 11/2020 | Strickland | |
| 2021/0010688 | A1 | 1/2021 | Biasotti et al. | |
| 2021/0078118 | A1 | 3/2021 | Li et al. | |
| 2021/0088251 | A1 | 3/2021 | Galvan et al. | |
| 2021/0164667 | A1 | 6/2021 | Yu et al. | |
| 2021/0180828 | A1 * | 6/2021 | Xing | F16M 13/022 |
| 2021/0381700 | A1 | 12/2021 | Aryeh | |
| 2022/0056715 | A1 | 2/2022 | O'Mara | |
| 2023/0026722 | A1 | 1/2023 | Yu | |
| 2023/0126498 | A1 | 4/2023 | Li | |
| 2023/0213214 | A1 | 7/2023 | Leezer et al. | |
| 2023/0213215 | A1 * | 7/2023 | DeRossett | F24F 13/32 62/262 |
| 2023/0213218 | A1 | 7/2023 | DeRossett | |
| 2023/0280048 | A1 | 9/2023 | Gray et al. | |
| 2023/0375222 | A1 * | 11/2023 | Leezer | F24F 1/027 |

FOREIGN PATENT DOCUMENTS

| | | | | |
|---|---|---|---|---|
| CN | 101876468 | A | 11/2010 | |
| CN | 103299756 | A | 9/2013 | |
| CN | 101876467 | B | 7/2014 | |
| CN | 108679746 | A | 10/2018 | |
| CN | 108931005 | A | 12/2018 | |
| CN | 109163388 | A * | 1/2019 | F24F 1/58 |
| CN | 110657501 | A | 1/2020 | |
| CN | 210320347 | U | 4/2020 | |
| CN | 210399219 | U | 4/2020 | |
| CN | 111219801 | A | 6/2020 | |
| CN | 110657487 | B | 8/2021 | |
| CN | 113465050 | A | 10/2021 | |
| KR | 20210080821 | A | 7/2021 | |
| WO | 2018133140 | A1 | 7/2018 | |
| WO | 2018133156 | A1 | 7/2018 | |
| WO | 2020220828 | A1 | 11/2020 | |
| WO | 2020220830 | A1 | 11/2020 | |
| WO | 2020224096 | A1 | 11/2020 | |
| WO | 2020224328 | A1 | 11/2020 | |
| WO | 2020228409 | A1 | 11/2020 | |
| WO | 2021050726 | A1 | 3/2021 | |

OTHER PUBLICATIONS

Guan, Guang H., United States Patent and Trademark Office, Non-Final Office Action issued in U.S. Appl. No. 17/843,176, 81 pages, dated Jan. 22, 2024.

Trpisovsky, Joseph F., United States Patent and Trademark Office, Non-Final Office Action issued in U.S. Appl. No. 17/566,416, 66 pages, dated Feb. 28, 2024.

Trpisovsky, Joseph F., United States Patent and Trademark Office, Third Party Art Submission issued in U.S. Appl. No. 17/685,336, 35 pages, dated Mar. 4, 2024.

Trpisovsky, Joseph F., United States Patent and Trademark Office, Non-Final Office Action issued in U.S. Appl. No. 17/685,336, 52 pages, dated Apr. 1, 2024.

Guan, Guang H., United States Patent and Trademark Office, Final Office Action issued in U.S. Appl. No. 17/566,438, 52 pages, dated Apr. 25, 2024.

Top Shelf A/C Corporation; Top Shelf TSB-2438 Air Conditioner Bracket; retrieved from https://www.amazon.com/TOP-SHELF-TSB-2438-Conditioner-Bracket/dp/B00NKQFSH6; Amazon; retrieved on Nov. 7, 2022.

ForestAir, The MINI Series, Retrieved from: https://www.forestair.ca/en/serie-mini-anglais , Retrieved on Oct. 27, 2021.

Electrical Know How, Electrical Wiring Diagrams for Air Conditioning Systems-Part Two, Retrieved from:http://www.electrical-knowhow.com/2014/05/electrical-wiring-diagrams-for-air-conditioning.html; Retrieved on Jul. 13, 2021.

Bright Hub Engineering, Parts of Split Air Conditioners: Outdoor Unit, Retrieved from:https://www.brighthubengineering.com/hvac/45044-parts-of-the-split-air-condioners-outdoor-unit/, Aug. 8, 2009.

Transmittal of Related Applications dated Dec. 15, 2022.

Alpine Hardware, Universal Window Air Conditioner Bracket—Heavy-Duty Window AC Support—Support Air Conditioner Up to 180 lbs.—For 12000 BTU AC to 24000 BTU AC Units (Heavy Duty), Retrieved from: https://alpinehardware.com/collections/ac-brackets/products/universal-window-air-conditioner-bracket-heavy-duty-window-ac-support-support-air-conditioner-up-to-180-lbs-for-12000-btu-ac-to-24000-btu-ac-units-heavy-duty, Retrieved on: Apr. 27, 2022.

Youtube video clip entitled "How to Install Friedrich Breeze through the Window," 8 pages, uploaded on May 9, 2013 by user Appliances Connection, Retrieved from internet: https://www.youtube.com/watch?v=cwK2-4PaVt8.

Guan, Guang H., United States Patent and Trademark Office, Notice of Allowance issued in U.S. Appl. No. 17/566,438, 98 pages, dated Sep. 18, 2024.

(56) References Cited

OTHER PUBLICATIONS

Guan, Guang H., United States Patent and Trademark Office, Final Office Action issued in U.S. Appl. No. 17/843,176, 54 pages, dated Aug. 14, 2024.
Trpisovsky, Joseph F., United States Patent and Trademark Office, Notice of Allowance issued in U.S. Appl. No. 17/566,416, 28 pages, dated Aug. 5, 2024.
Trpisovsky, Joseph F., United States Patent and Trademark Office, Notice of Allowance issued in U.S. Appl. No. 17/685,336, 43 pages, dated Oct. 23, 2024.
Trpisovsky, Joseph F., United States Patent and Trademark Office, Notice of Allowance issued in U.S. Appl. No. 17/566,416, 28 pages, dated Nov. 22, 2024.

* cited by examiner

ADJUSTABLE BRACKET FOR WINDOW AIR CONDITIONER

BACKGROUND

Air conditioning ("A/C") units are typically classified into split type air conditioning units and integral type air conditioning units. Split type air conditioning units usually include an indoor unit and an outdoor unit. The indoor unit is installed indoors, and draws indoor air into the unit to allow the drawn air to exchange heat with refrigerant, and discharges the heat-exchanged air to the conditioned indoor space. The outdoor unit allows the refrigerant introduced from the indoor unit to exchange heat with outdoor air such that the refrigerant is in a state available for heat exchange with indoor air, and then provides the refrigerant to the indoor unit. The indoor unit and the outdoor unit are usually connected to each other by a refrigerant pipe through which refrigerant flows.

By contrast, integral type air conditioners (e.g., standard window air conditioning units) usually include all the unit components, such as electrical panels, heat exchangers (e.g., evaporators, condensers), compressors, and fans, encased in a housing as a single packaged unit, which is mounted in a window opening atop a window sill. These window A/C units occupy a large portion of the window space, block sunlight and window view, and hinder the ability of the window to be opened or closed freely. In addition, they are difficult to install, and are commonly of relatively low efficiency because of the size limitations of the window-mounted packaged housing.

As a solution to some of the problems associated with standard integrated window A/C units, "saddle-type" window units have been developed. A saddle-type window A/C unit is basically a hybrid between a split-type unit and an integral unit, in which an outdoor unit is separate from, but functionally coupled to, an indoor unit. The saddle unit sits on a mounting bracket that straddles the sill of a window opening. These saddle-type units, however, are difficult to install due, in part, to their size and their relative inability to adjust to various size openings and window thicknesses. Standard saddle-type window units have one or more feet that must be adjusted independently while the heavy unit is being installed. This is not only cumbersome, because the feet are outside the window and the unit is very heavy, but also dangerous for the installer (and persons beneath) if the installation is high above ground.

Also, as discussed in co-pending application entitled Window-Mounted Air Conditioner, bearing U.S. application Ser. No. 17/685,336, filed on Mar. 2, 2022, the entire contents of which are herein incorporated by reference, although some window A/C units in the past have attempted to add a heat pump, none of such units could operate at very cold temperatures. In fact, most would cease operating around 40 degrees Fahrenheit. Adding a larger heat pump would make the unit not fit within many standard window openings. Adding such a cold weather heat pump to a window A/C unit would add approximately 6"-8" to the height and approximately 6"-8" to the width of such a window A/C unit. And, such a heat pump would also add approximately an additional 50% to 90% of weight to the appliance. As a result, not only would it be extremely dangerous to attempt to install such a heavy appliance through a window, but the added size of such an apparatus would not even fit through most standard window openings in the first place.

Mounting or installation brackets for saddle or other type A/C units typically require fastening the bracket or a portion of the bracket to a window sill. If adjustment is needed, it is achieved by loosening the fasteners, adjusting the width, and then re-tightening the fasteners. This can be cumbersome and time consuming.

Accordingly, with or without a heat pump, a need exists in the art for an adjustable bracket for a window air conditioner that can be installed through most standard window openings. Also, it is desired to provide such a bracket that requires no fasteners on the indoor side of the A/C unit. Also, it is desired to provide such a bracket that is infinitely adjustable between its minimum and maximum width positions. It is also desired to provide such a bracket that includes a quick locking mechanism that makes installation quick and easy.

SUMMARY

The herein-described embodiments address these and other problems associated with the art by providing an adjustable bracket for a window air conditioner having adjustability in the thickness of walls/sills to which it can be mounted.

Another related object of the disclosure is to provide such an air conditioning unit that includes a separate mounting bracket that is installed in the window opening prior to installation of the air conditioner. Yet another object is to provide such a bracket that is safer to use and provides a more secure mount than known brackets. Another object is to provide a bracket that is adjustable for varying window sill sizes and thicknesses. Another object is to provide a bracket that allows for adjustably locking the opening size. Other objects and advantages of the disclosed apparatus will become apparent from the specification and appended claims and from the accompanying drawing illustrative of the invention.

In an embodiment, an adjustable bracket for a window air conditioner includes a base having a platform and an indoor slide base, the base configured to reside atop a sill of a window such that the platform is approximately horizontally disposed once the bracket is installed at a window sill. The base further comprises an indoor slide base coupled to the base and having a pawl coupled to a ratchet release handle. An indoor portion is also provided that has a sliding base configured to slide within the indoor slide base in a direction perpendicular to the sill of a window. The sliding base further comprises a first leg and a second leg, wherein the first leg further comprises ratchet teeth configured to engage with the pawl. An outdoor portion is also included and is configured to slide within the base in a direction perpendicular to the base; wherein the one or more of the indoor portion and the outdoor portion can occupy a retracted position and an extended position with respect to the base.

In another embodiment, an adjustable bracket for a window air conditioner is provided that includes a base, an indoor portion, and an outdoor portion arranged in a saddle-shaped configuration. The base further comprises an indoor slide base having a first set of ratchet teeth near a first side of the indoor slide base and a second set of ratchet teeth near a second side of the indoor slide base, wherein the second set of ratchet teeth are disposed parallel to the first set of ratchet teeth at a first distance from the first set of ratchet teeth. The base further comprises a first set of outdoor ratchet teeth near a first side of the indoor slide base and a second set of outdoor ratchet teeth near a second side of the indoor slide base, wherein the second set of outdoor ratchet teeth are disposed parallel to the first set of outdoor ratchet teeth at a first distance from the first set of outdoor ratchet teeth. The indoor portion further comprises a sliding base having a first leg and a second leg depending downwardly from the first leg. The indoor portion further comprises a first pawl movably coupled to the first leg at a first side thereof and a second pawl movably coupled to the first leg at a second side thereof; a ratchet release handle coupled to the first pawl via a first arm and coupled to the second pawl via a second arm, the ratchet release handle being movable from a first position to a second position, wherein in the first position the first pawl and the second pawl are spring biased into engagement with the ratchet teeth and in the second position the first pawl and the second pawl are out of engagement with the ratchet teeth. An outdoor portion further comprises an outdoor slide, the outdoor slide having a first leg, a second leg, and a third leg, wherein the first outdoor pawl is movably coupled to the first leg and the second outdoor pawl is movably coupled to the third leg; and wherein the second leg further comprises a ratchet release configured to move the first pawl and the second pawl into and out of engagement with the outdoor ratchet teeth.

In another embodiment, an adjustable bracket for a window air conditioner comprises a base; an indoor portion slidably coupled to the base, the indoor portion further comprising a locking handle rotatably coupled thereto and rotatable about a shaft. An outdoor portion is included that is slidably coupled to the base, the outdoor portion further comprising outdoor rails configured to be received within the base, wherein at least a portion of the outdoor rails are pivotable between a first position and a second position, wherein the second position depends downwardly approximately 90 degrees from the first position. The locking handle is further coupled to a locking wheel having a first slot and a second slot, wherein the first slot has a first end and a second end, wherein the first end is radially disposed at a distance from the shaft that is different from that of the second end, and wherein the second slot has a first end and a second end, wherein the first end is radially disposed at a distance from the shaft that is different from that of the second end. A first locking cam is coupled to the first slot via a first cam pin; and a second locking cam coupled to the second slot via a second cam pin. Rotation of the locking handle in a first direction moves the first locking cam and the second locking cams away from each other, and rotation of the locking handle in a second direction moves the first locking cam and the second locking cams toward each other.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
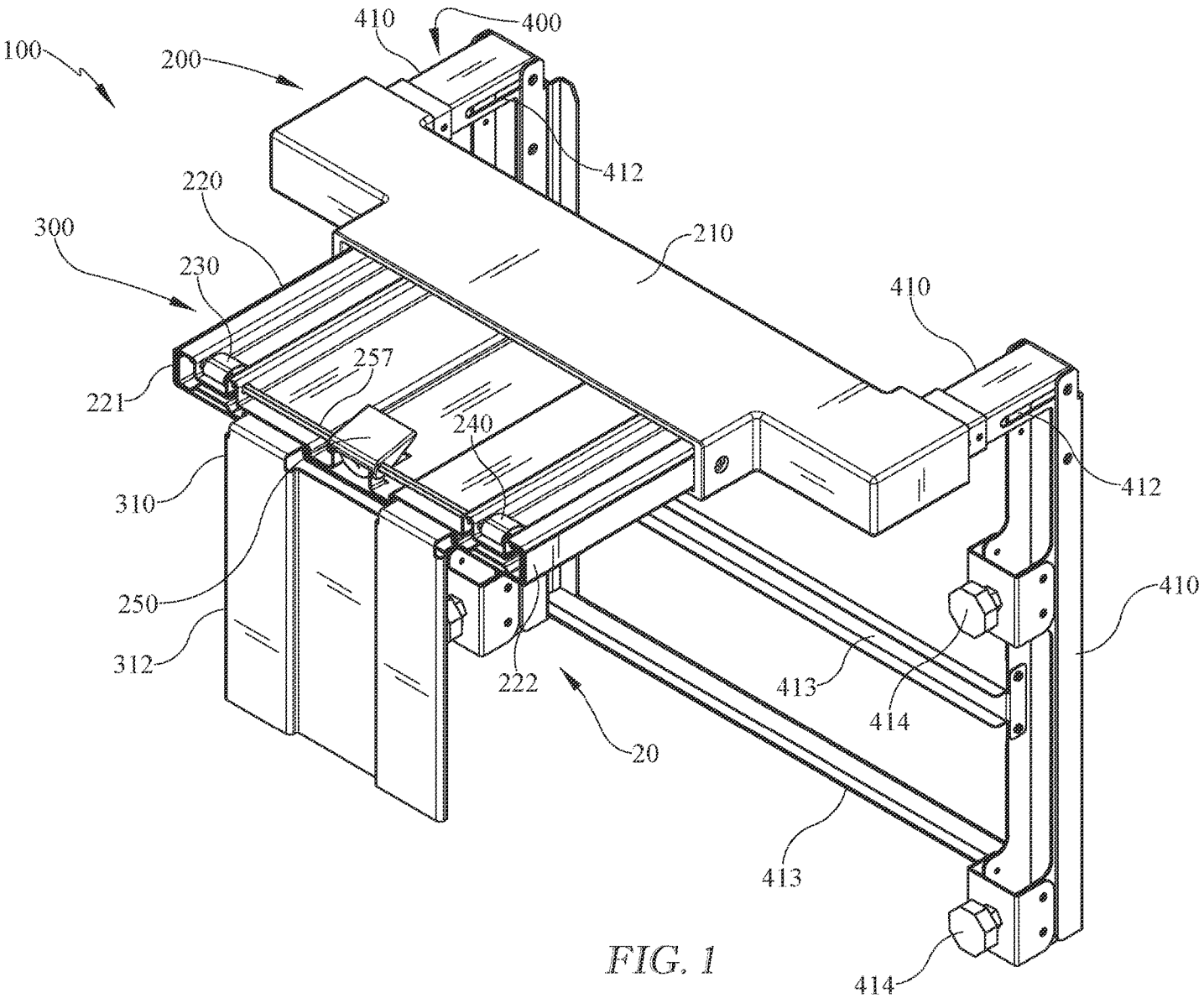
FIG. 1 is a top perspective view from an indoor viewing angle of an embodiment of the bracket, with the indoor portion of the bracket in a retracted position.

The embodiments discussed hereinafter are directed in part to an adjustable bracket for a window-mounted air conditioner and a method for installing the same. The structures, features, and functionality of the disclosed apparatus are significant improvements over the prior art. The apparatus described herein provides for easy and safe installation of window A/C units of varying styles, and enables easy adjustability to the size and shape of the window opening. The embodiments shown and described can be utilized with many types and styles of A/C units, including, without limitation, integral units, split units, or hybrid window air conditioning units of the type described in co-pending patent application entitled "Hybrid Window Air Conditioning Unit", bearing U.S. patent application Ser. No. 17/566,416, filed Dec. 30, 2021, the entire contents of which are incorporated herein by reference.

Turning now to the Figures, wherein like numbers denote like parts throughout the several views, the overall configuration of various embodiments of an adjustable bracket for a window A/C unit will be described. In general, the Figures depict an adjustable bracket 100 for a window air conditioner, wherein the bracket 100 has three primary sections or portions: a base 200, an indoor portion 300 and an outdoor portion 400. Together the base 200, indoor portion 300, and outdoor portion 400 make up a generally inverted U-shaped, or "saddle" bracket, having an open space 20 between the indoor portion 300 and the outdoor portion 400. The open space 20 is bounded at the top by the base 200. The open space 20 is configured to be place over a window sill, such that the indoor portion 300 is situated indoors of and downwardly depending with respect to the window sill, and the outdoor portion 400 is situated outdoors of and downwardly depending with respect to the window sill. In this manner, the open space 20 can receive the window sill 20 therewithin when the bracket 100 is installed in a window opening.

With reference now to FIGS. 1-7, an embodiment of the bracket 100 is shown. The base 200 includes a platform 210 for being situated atop a window sill. The platform 210, when installed on a window sill, provides a generally horizontal surface on which an air conditioner, or a portion of an air conditioner, may be placed. The base 200 also includes one or more indoor slide bases 220 and one or more outdoor rail receiving openings 212. In the embodiment shown, the indoor slide base 220 includes a first side 221 and a second side 222. The first and second sides 221, 222, respectively can be of many common designs and materials, it being important only that they be of sufficient strength and stiffness to carry out their purpose, as described below. In the embodiment shown, the first and second sides 221, 222, respectively of indoor slide base 220 are formed of metal channel material, such as a "C" channel. However, the indoor slide base 220 need not be formed separately of the base 200 but could, if desired, be formed as part of the base 200. The indoor slide base 220 facilitates the sliding movement of the indoor portion 300, described below.

Figure 2:
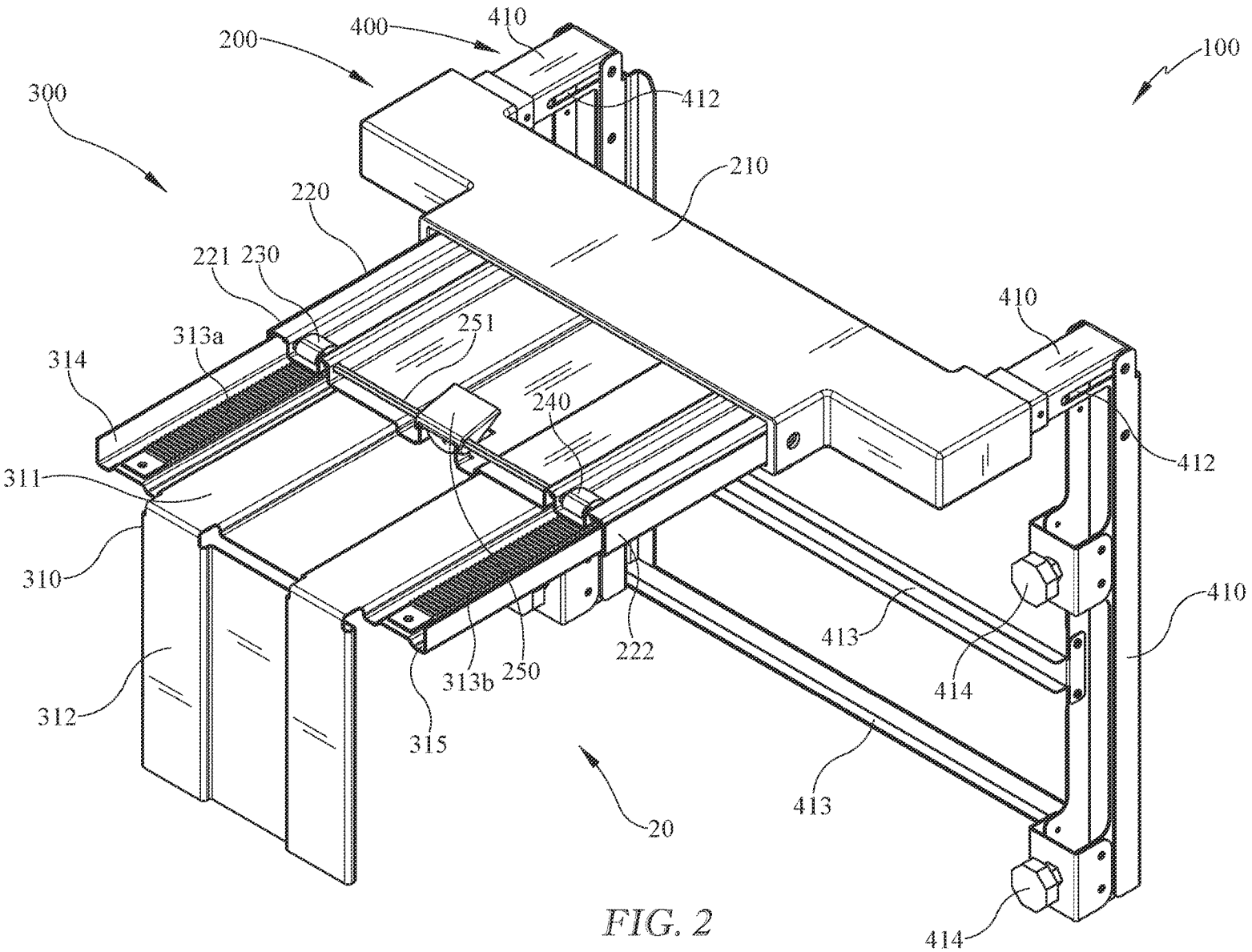
FIG. 2 is a top perspective view of the bracket of FIG. 1, with the indoor portion of the bracket in an extended position.
Figure 3:
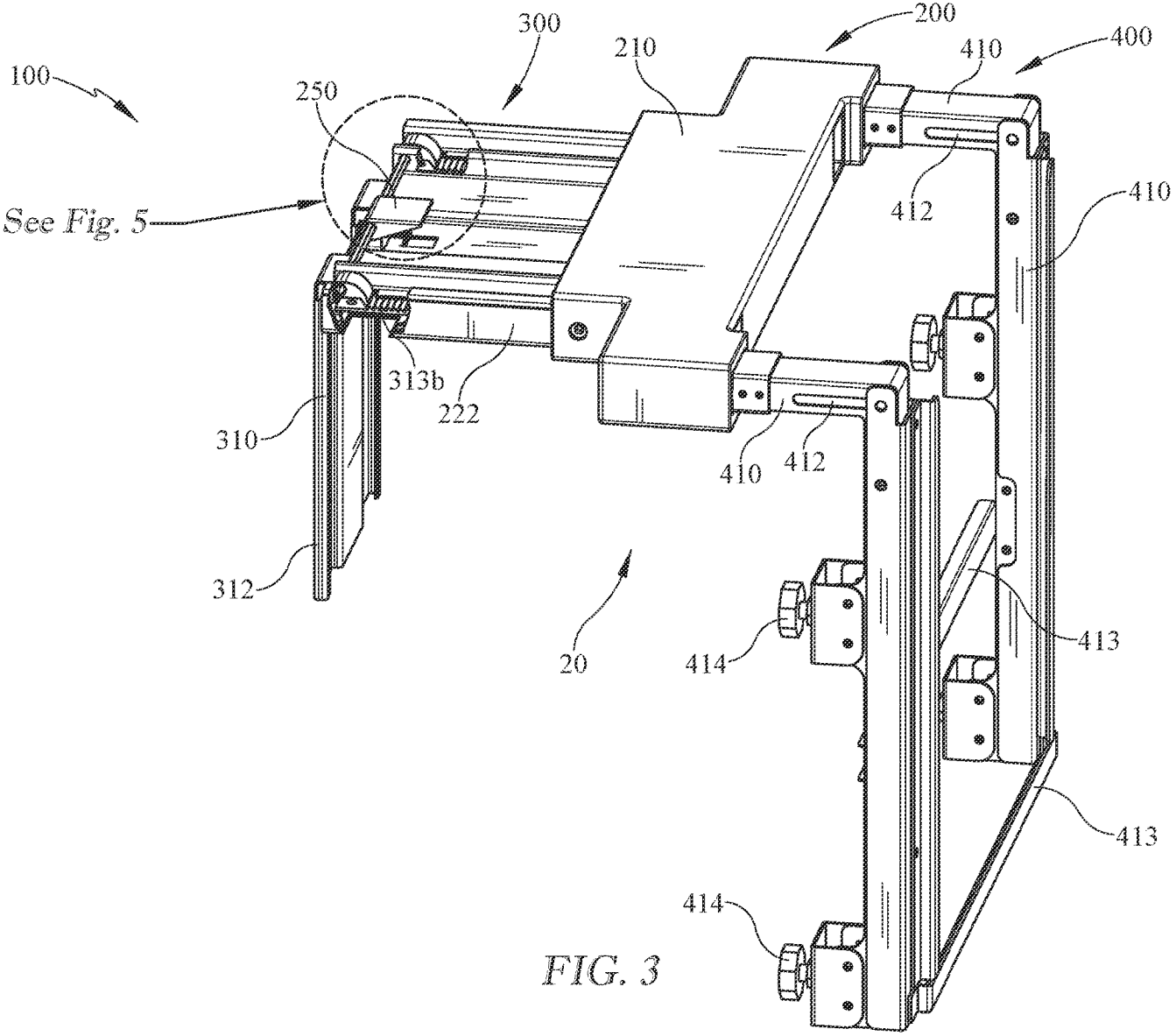
FIG. 3 is a top perspective view from an outdoor viewing angle of the bracket of FIG. 2.
Figure 4:
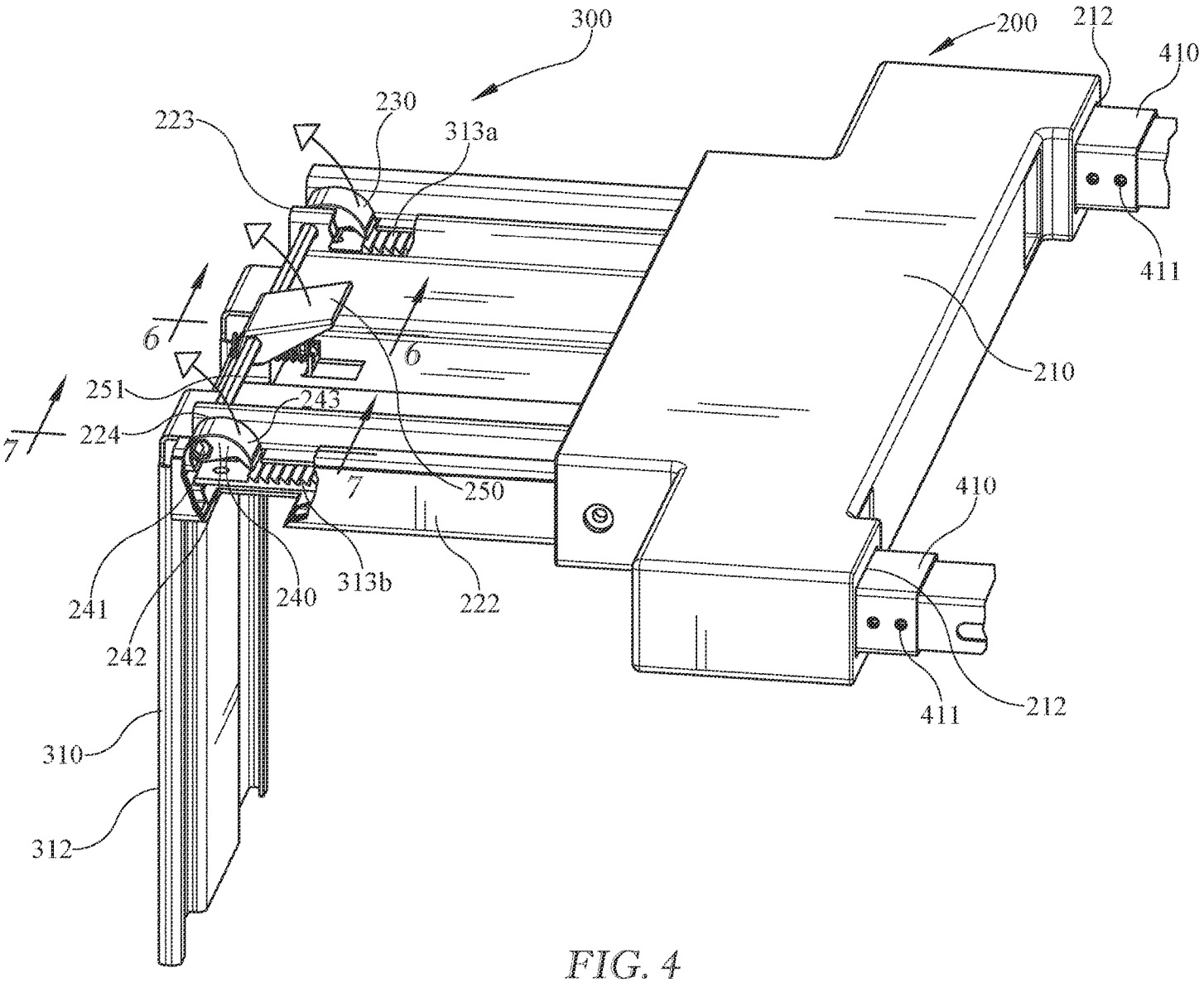
FIG. 4 is a close up view of the indoor portion of the bracket of FIG. 3.

The indoor portion 300 includes a sliding base 310. The sliding base 310 of the depicted embodiment takes the shape of an "L" section, having a first leg 311 and a second leg 312. The second leg 312 joins the first leg 311 at approximately a 90-degree angle, depending downwardly. The first leg 311 further includes at least one row of ratchet teeth 313. In the embodiment shown, two rows of ratchet teeth 313 are included: a first row 313*a* and a second row 313*b*. The rows of ratchet teeth 313*a*, 313*b* are fixed to or integral with the first leg 311. The first leg 311 is translatable into and out of the indoor slide base 220 of the base 200. As best seen in FIGS. 2-4, the first row 313*a* of the sliding base 310 translates (that is, slides) within the first side 221, while the second row 313*b* of the sliding base 310 slides within the second side 222. The base 200 further includes a ratchet release handle 250 coupled via a connecting rod 251 to a first pawl 230 and a second pawl 240. In the embodiment shown, the connecting rod 251 is of a non-circular cross section (hexagonal in the Figures) and the ratchet release handle 250 is snugly fitted about the connecting rod 251 with a complementary hexagonal opening 252 therethrough. In this manner the ratchet release handle 250 is keyed to the connecting rod 251, such that rotating the ratchet release handle 250 thereby rotates the connecting rod 251. Other forms of connection and/or keying of the ratchet release handle 250 to the connecting rod 251 are contemplated, including but not limited to friction fit, other non-circular shaped sections, spline/key combinations, pin/slot, adhesive, other physical attachment, and the like.

Figure 5:
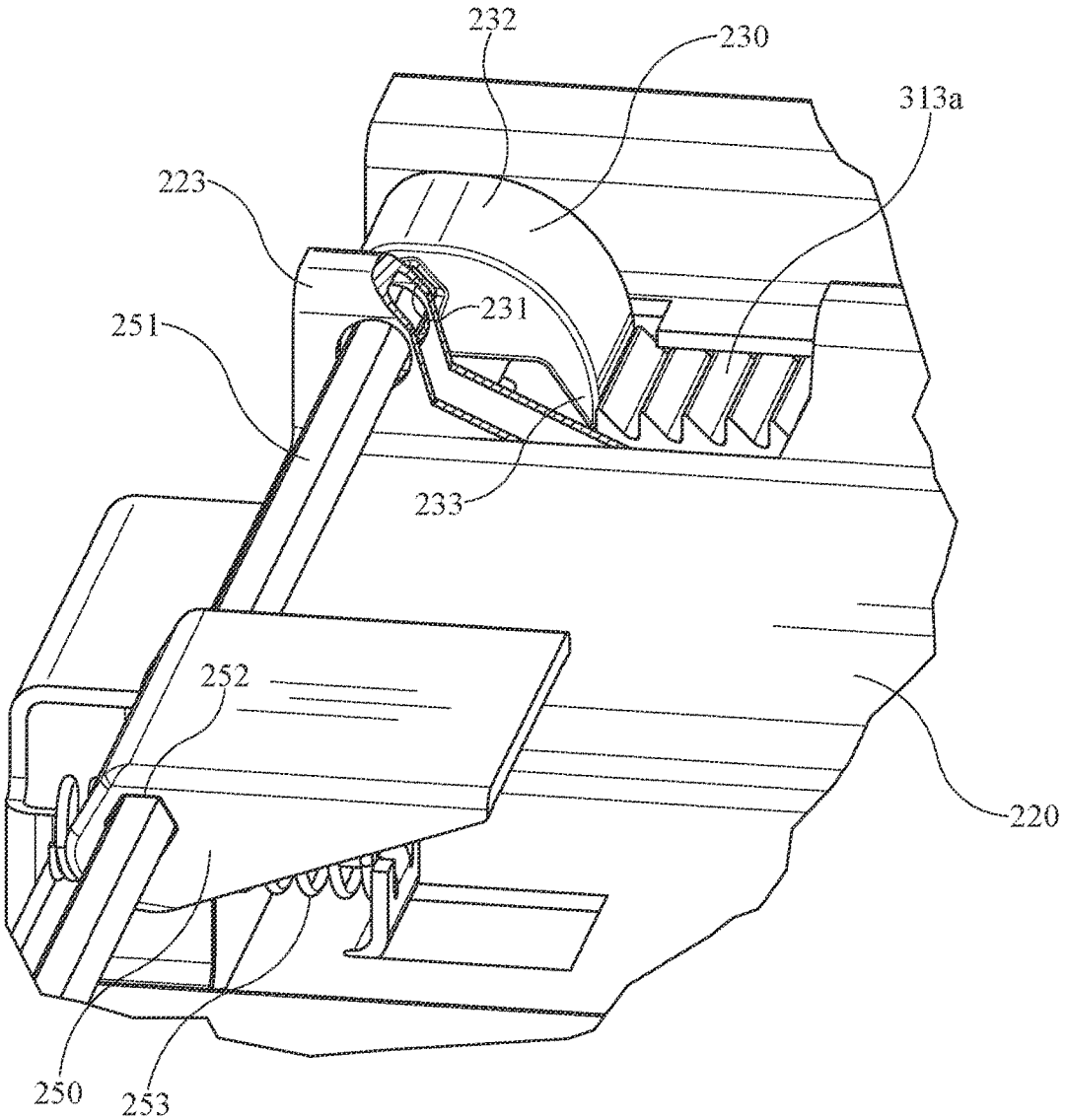
FIG. 5 is a close-up detail view of a first pawl and a ratchet release handle of the bracket of FIG. 1.
Figure 7:
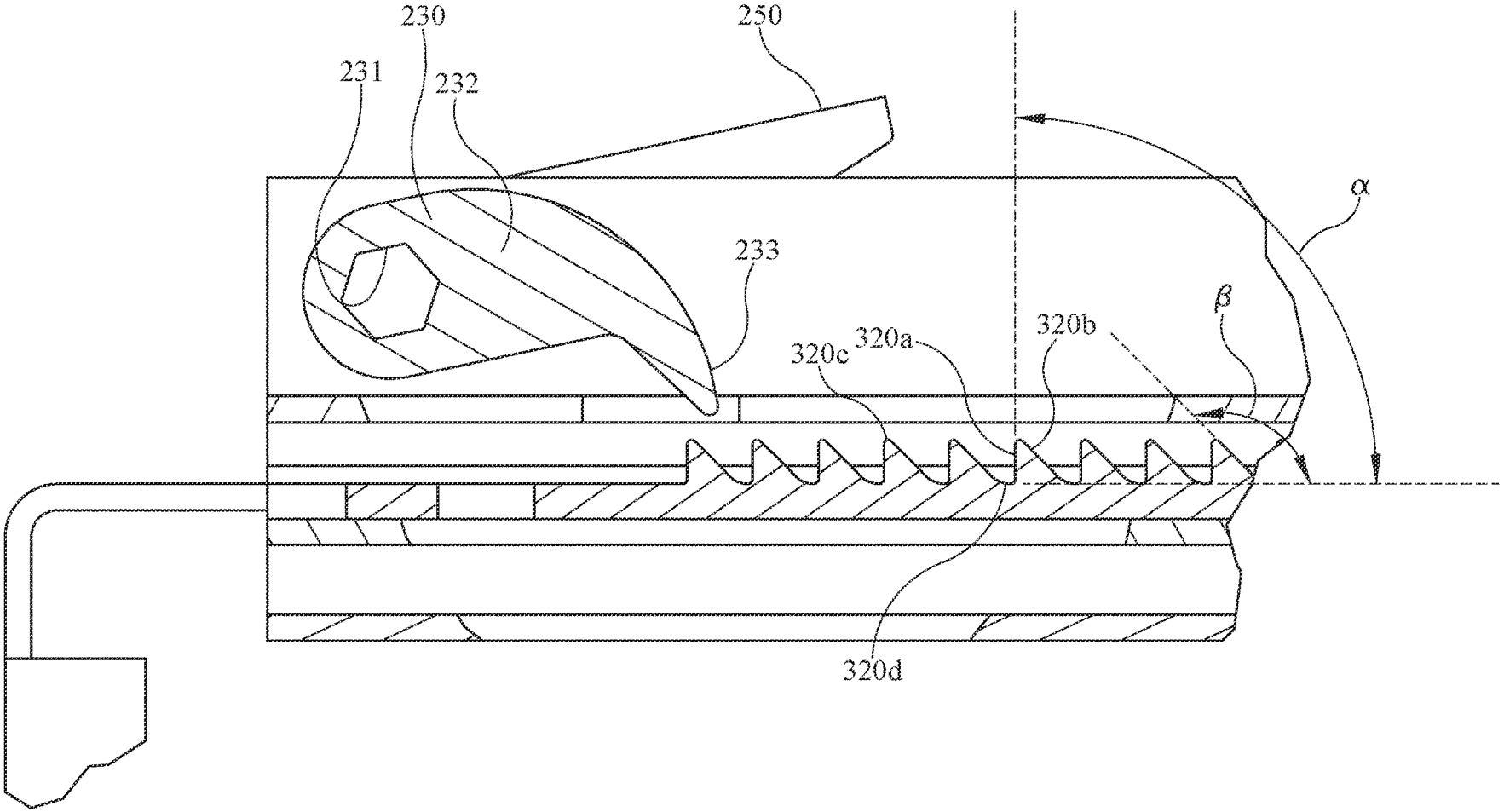
FIG. 7 is a section view taken at section line 7-7 of FIG. 4 taken through a second pawl.

As seen in FIGS. 3-5, the connecting rod 251 additionally is coupled to each of the first pawl 230 and the second pawl 240. In the embodiment shown (FIG. 5), the first pawl 230 has an opening 231 therein to receive the connecting rod 251 in complementary fashion. Similarly, the second pawl 240 has an opening 241 therein to receive the connecting rod 251 in complementary fashion (FIG. 7). The connections between the pawls 230, 240 and the connecting rod 251 can similarly be of the various constructions discussed above, if desired. Referring again to FIG. 2-4, the location of the first pawl 230 on the connecting rod 251 is such that the first pawl 230 resides over top of or adjacent to the first row 313*a* of ratchet teeth. Similarly, the location of the second pawl 240 on the connecting rod 251 is such that the second pawl 240 resides over top of or adjacent to the second row 313*b* of ratchet teeth. In this manner, as will be explained below, the first pawl 230 and second pawl 240 are able to interact with the first row 313*a* and second row 313*b* of ratchet teeth, respectively. As seen in FIGS. 4-5, the connecting rod 251 is rotatably coupled to the indoor slide base 220 at one or more rotational supports 223, 224 to provide stable, rotational support to the connecting rod 251.

Figure 6:
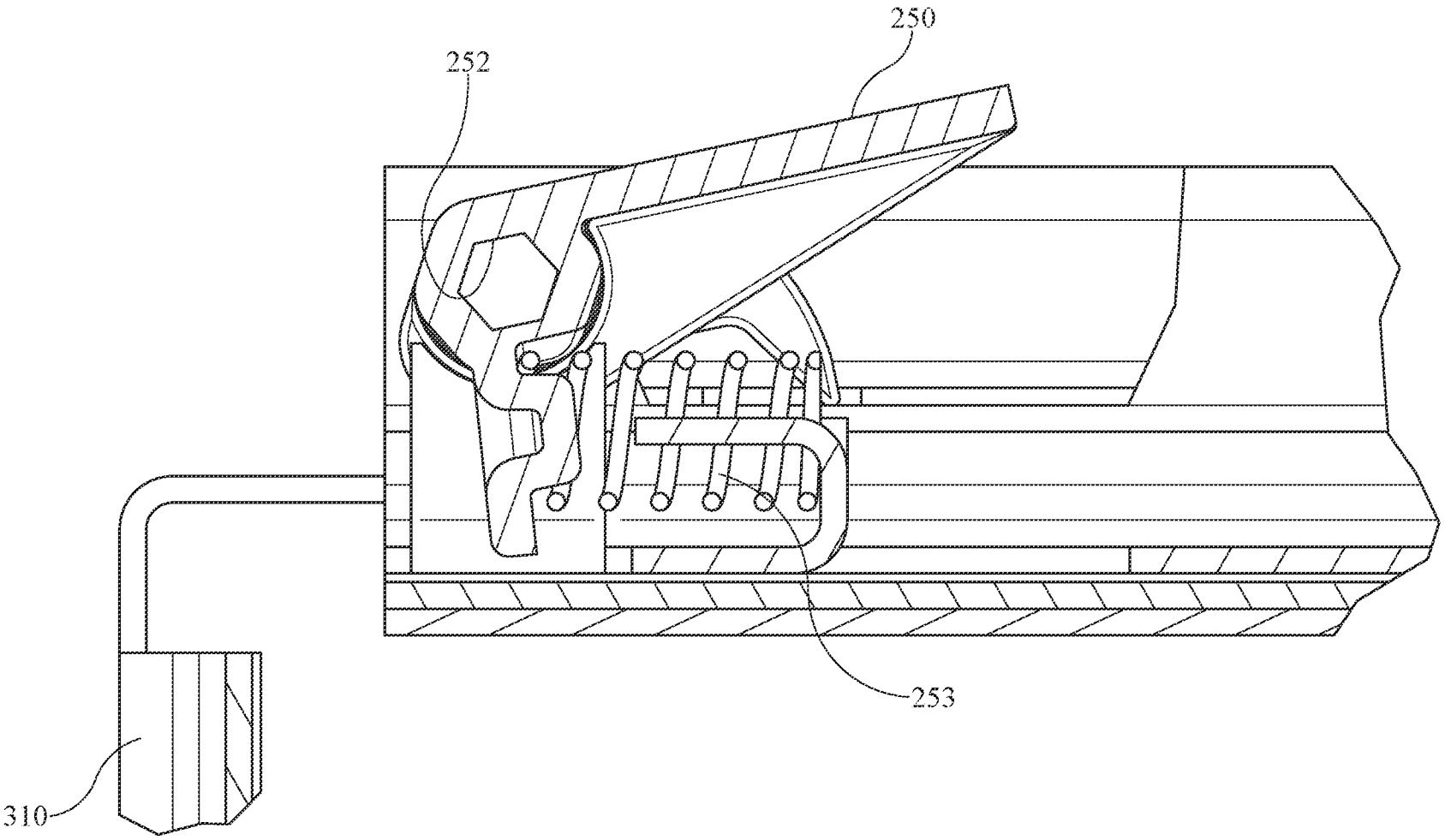
FIG. 6 is a section view taken at section line 6-6 of FIG. 4 taken through the ratchet release handle.

With continued reference to FIGS. 2-5 and 7, the first row 313*a* of ratchet teeth is linearly arranged on a first side 314 of sliding base 310. The second row 313*b* of ratchet teeth is linearly arranged on a second side 315 of sliding base 310. As best seen in FIG. 7, each ratchet tooth 320 includes a first surface 320*a* and a second surface 320*b* joined at ridge 320*c*. Each adjacent ratchet tooth 320 is joined by a valley 320*d*. The first surface 320*a* is disposed at a first angle, alpha, measured counterclockwise in FIG. 7 at a valley and with respect to a horizontal plane, of approximately 90 degrees (that is, the first surface 320*a* is approximately vertical). However, the first surface 320*a* could take on a range of angles, from approximately 80 degrees to approximately 100 degrees. The second surface 320*b* is disposed at a second angle, beta, measured counterclockwise in FIG. 7 at a valley and with respect to a horizontal plane, of approximately 135 degrees. However, the second surface 320*b* could take on a range of angles, from approximately 120 degrees to approximately 150 degrees. The first pawl 230 has a body 232 and a free end 233. The second pawl 240 similarly has a body 242 and a free end 243. As with typical pawls/ratchet arrangements, the pawls 230, 240 are spring biased in a given rotational direction. As best seen in FIGS. 5-6, this spring bias force is provided by a spring 253 coupled at one end to the ratchet release handle 250 and at another end to the indoor slide base 220. As depicted in the Figures, the spring bias force tends to make the ratchet release handle 250 rotate in a clockwise position. That is, to overcome the spring bias force, the ratchet release handle 250 must be physically rotated in a counterclockwise direction.

The rows of ratchet teeth 313*a*, 313*b* are arranged such that the indoor sliding base 310 can translate in one direction (by simply pushing the sliding base 310 toward the indoor slide base 220), but that the indoor sliding base 310 cannot freely translate in the opposite direction (that is, cannot be simply pulled away from the indoor slide base 220) because the free ends 233, 243 of the pawls 230, 240 are engaged in a valley 320*d* of respective ratchet teeth 320. When it is desired to decrease the size of the open space 20, the sliding base 310 is pushed toward the indoor slide base 220 and the first pawl 230 and second pawl 240 simply ride on each ratchet tooth 320 and move into successive valleys 320*d*. The spring 253 provides the bias force to move the free ends 233, 243 into each valley 320*d*. This movement is what happens, as an example, when the indoor portion 300 of the bracket 100 is moved from its position as shown in FIG. 2 (extended position) to its position as shown in FIG. 1 (retracted position). However, when it is desired to increase the size of the open space 20, the sliding base 310 cannot simply be pulled away from the indoor slide base 220. This is because the free ends 233, 243 of each pawl 230, 240, resides in a valley 320*d* of respective ratchet teeth 320, and the first surface 320*a* would bear directly against and interfere with the free ends 233, 243 in the face of an attempted pulling motion. Rather, as best seen in FIGS. 5-7, in order to translate the sliding base 310 in a direction away from the indoor slide base 220, a physical rotational force is imparted to the connecting rod 251 (via, for example, the ratchet release handle 250) in a direction opposing the spring bias force, and for a rotational distance great enough to enable the free ends 233, 243 to escape the ratchet teeth 320 (for example, to allow the free ends 233, 243 to be at an elevation greater than that of the ridge 320*c*). Once the free ends 233, 243 are out of engagement with the ridges 320*c*, the sliding base 310 can be pulled away from the indoor slide base 220, thus increasing the size of the open space 20.

The base 200 and/or platform 210 also provides a location for the outdoor portion 400 to couple thereto. In particular (FIGS. 3 and 4), rail receiving openings 212 are located in the base 200 and are configured to receive therein outdoor rails 410 of the outdoor portion 400. The outdoor rails 410 can have fastener openings 411 that can facilitate coupling the outdoor rails 410 to the base 200. Alternatively, or additionally, the outdoor rails 410 can have adjustment structures 412 to facilitate sliding adjustment of the outdoor portion 400 with respect to the base 200. Such adjustment structures 412 can include, but are not limited to: openings for fasteners; pins/slots; ball detents/openings; and the like. Each outdoor rail 410 is rotatable such that the outdoor rail 410, or a portion thereof, can be moved from a first configuration where the outdoor rail 410 is substantially parallel to the platform 210 to a second configuration where a portion of the outdoor rail 410 is substantially perpendicular to the platform 210. FIGS. 1-3 depict the outdoor rails 410 after they have been moved from their first configuration to their second configuration. The outdoor portion 400 also can include one or more cross bars 413 connecting each outdoor rail 410. Additionally, one or more feet 414 are coupled to the outdoor rails 410. The feet 414 can be used to help secure or stabilize the outdoor portion 400 against an exterior wall.

The bracket 100 is advantageously designed to be installed in a window sill prior to installation of an air conditioner thereon. This eliminates the need for an installer to have to deal with the heavy weight and the bulk of an air conditioner while trying to safely install the air conditioner. To install, first the window sash is opened to expose the window sill. The bracket 100 is placed over the window sill such that the open space 20 receives therewithin the wall supporting the window sill. Once the desired location and orientation of the bracket 100 has been achieved, the fastener openings 411 are used to couple the outdoor rails 410 to the base 200. As discussed above, the indoor portion 300 and outdoor portion 400 are adjustable to properly and safely arrange the bracket 100 such that the air conditioner to be placed thereon is properly supported. The outdoor portion 400 is slideably adjusted to its desired configuration by moving the outdoor rails 410 to the desired location and fastening the outdoor rails 410 to the rail receiving openings 212.

The indoor portion 300 is adjusted to place the sliding base 310 in contact with (or as close to as possible) the indoor wall. This is done by simply pushing the sliding base 310 toward the indoor wall. If the indoor portion 300 is desired to be extended to make a larger opening 20, this is done by lifting the ratchet release handle 250, thus rotating the connecting rod 251 in a rotational direction opposite that of the spring force. The ratchet release handle 250 is rotated far enough to move the free ends 233, 243 of the first and second pawls 230, 240, respectively, out of engagement with the ratchet teeth 320. The sliding base 310 is then pushed toward the indoor wall (that is, toward the indoor slide base 220) to place the sliding base 310 in the desired position relative to the indoor wall. Once the desired location has been achieved, the rotational force being applied to the ratchet release handle 250 is removed, and the spring bias force then brings the free ends 233, 243 of the first and second pawls 230, 240, respectively, into engagement with valleys 320*d* of the ratchet teeth 320. Now that the outdoor portion 400 and indoor portion 300 have been placed into their desired positions, an air conditioner can be placed atop (and secured to, if desired) the bracket 100.

FIGS. 8-16 depict another embodiment of the bracket 100. The base 200 includes a platform 210 for being situated atop a window sill. The platform 210, when installed on a window sill, provides a generally horizontal surface on which an air conditioner, or a portion of an air conditioner, may be placed. The platform 210 includes fastener openings 228 therein to facilitate fastening the platform 210 of the base 200 to the outdoor rails 410. The base 200 also includes one or more indoor slide bases 220 and one or more outdoor rail receiving openings 212. In the embodiment shown, the indoor slide base 220 includes an indoor slide retainer 225. The indoor slide retainer 225 serves to retain within the base 200 the structures facilitating sliding movement of the indoor portion 300 with respect to the indoor slide base 220 of the base 200, as will be described below.

The indoor portion 300 includes a sliding base 310. The sliding base 310 of the depicted embodiment takes the shape of an "L" section, having a first leg 311 and a second leg 312. The second leg 312 joins the first leg 311 at approximately a 90-degree angle, depending downwardly. The indoor slide base 220 includes at least one row of ratchet teeth 226 (sec FIGS. 10A, 10B, and 10C). In the embodiment depicted in these Figures, a first row 226*a* and a second row 226*b* are provided, each on an opposite side of the indoor slide base 220. The embodiment depicted in the Figures is a further preferred version in which the first row 226*a* includes and upper row 226*c* and a lower row 226*d*, and the second row 226*b* includes an upper row 226*c* and a lower row 226*f*. These separate upper/lower rows of ratchet teeth 226 are not required, but provide some additional benefits as described below.

Figure 8:
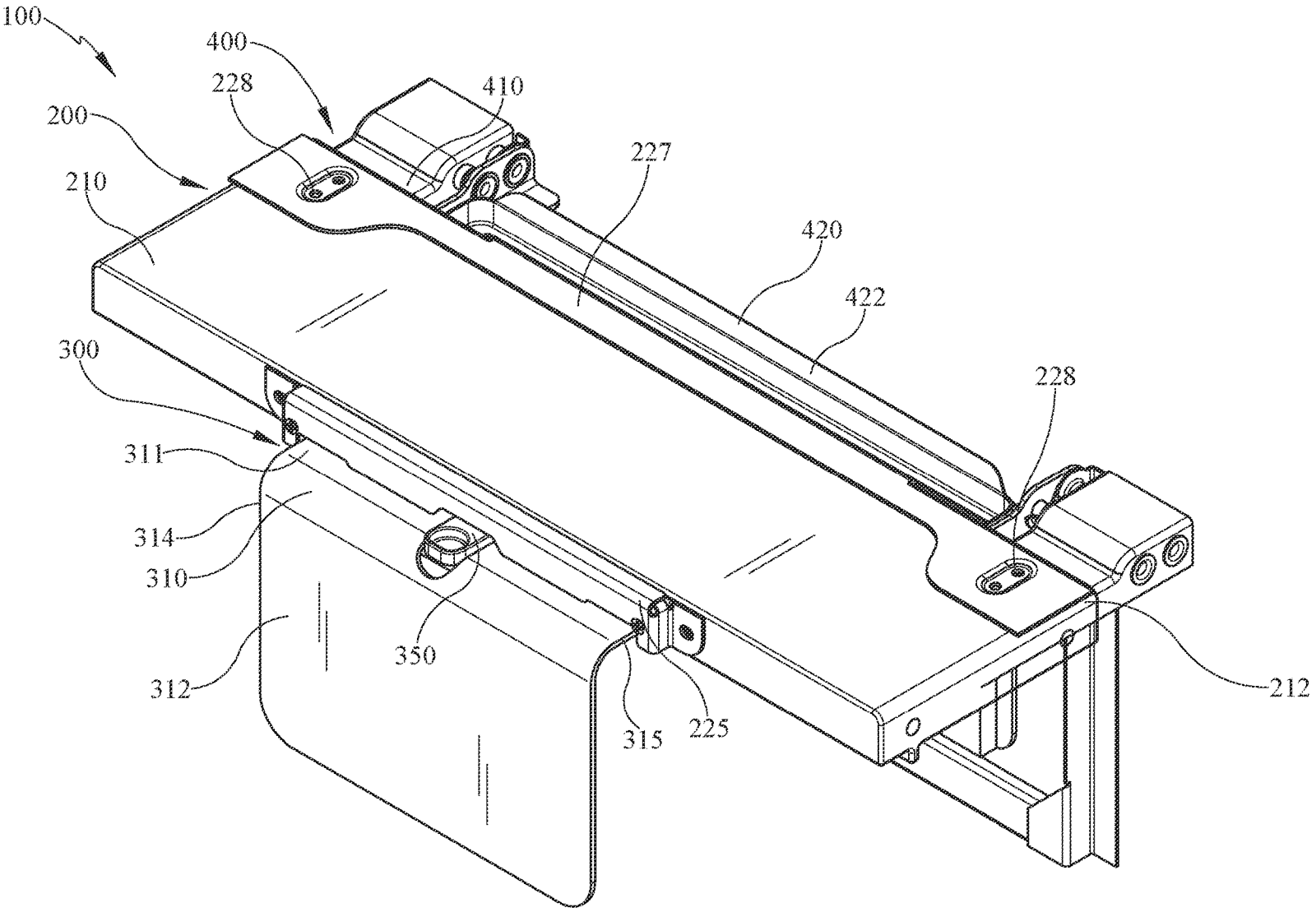
FIG. 8 is a top perspective view from an indoor viewing angle of an embodiment of the bracket, with the indoor portion of the bracket in a retracted position.
Figure 9:
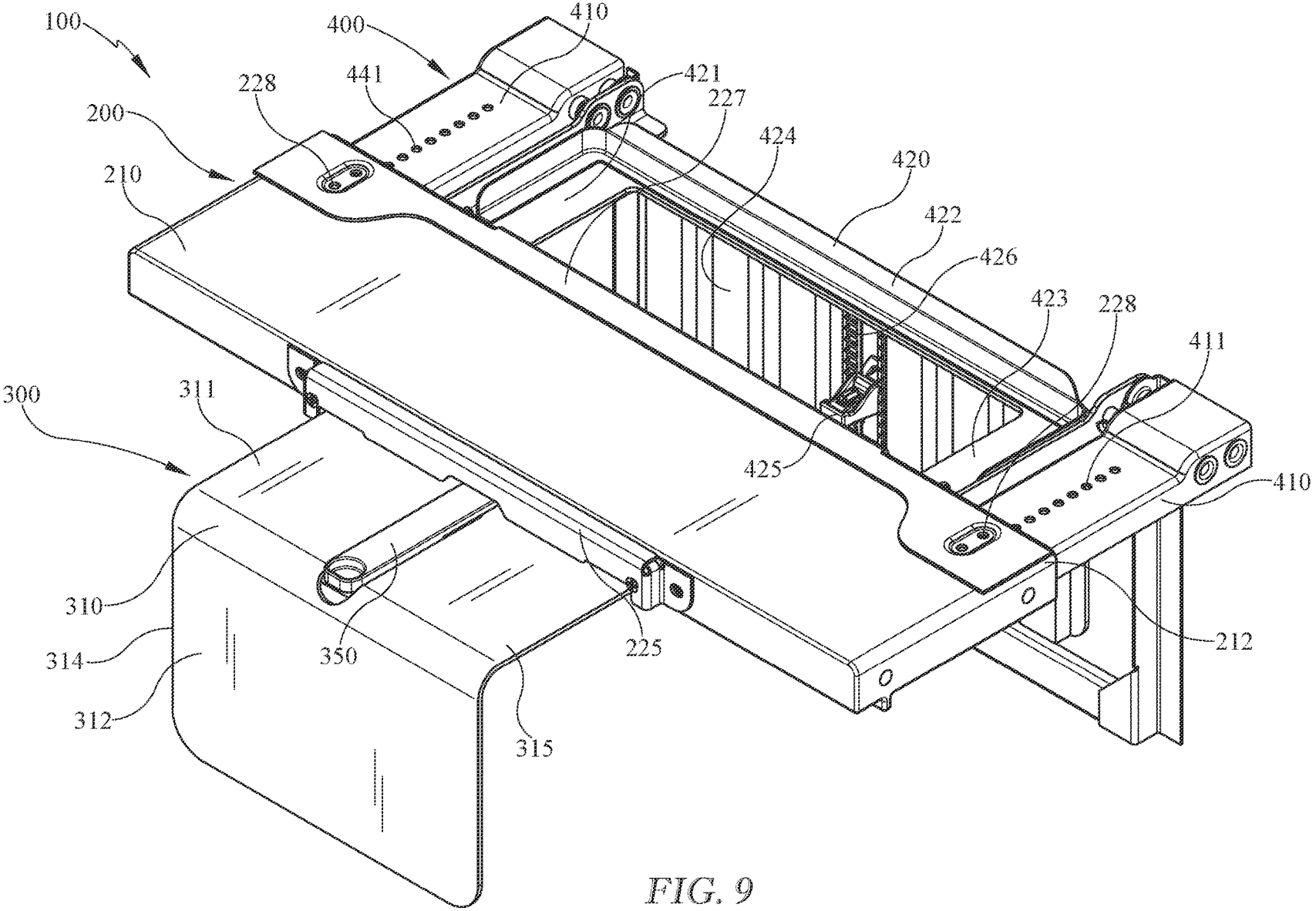
FIG. 9 is a top perspective view of the bracket of FIG. 8, with the indoor portion of the bracket in an extended position.
Figure 10A:
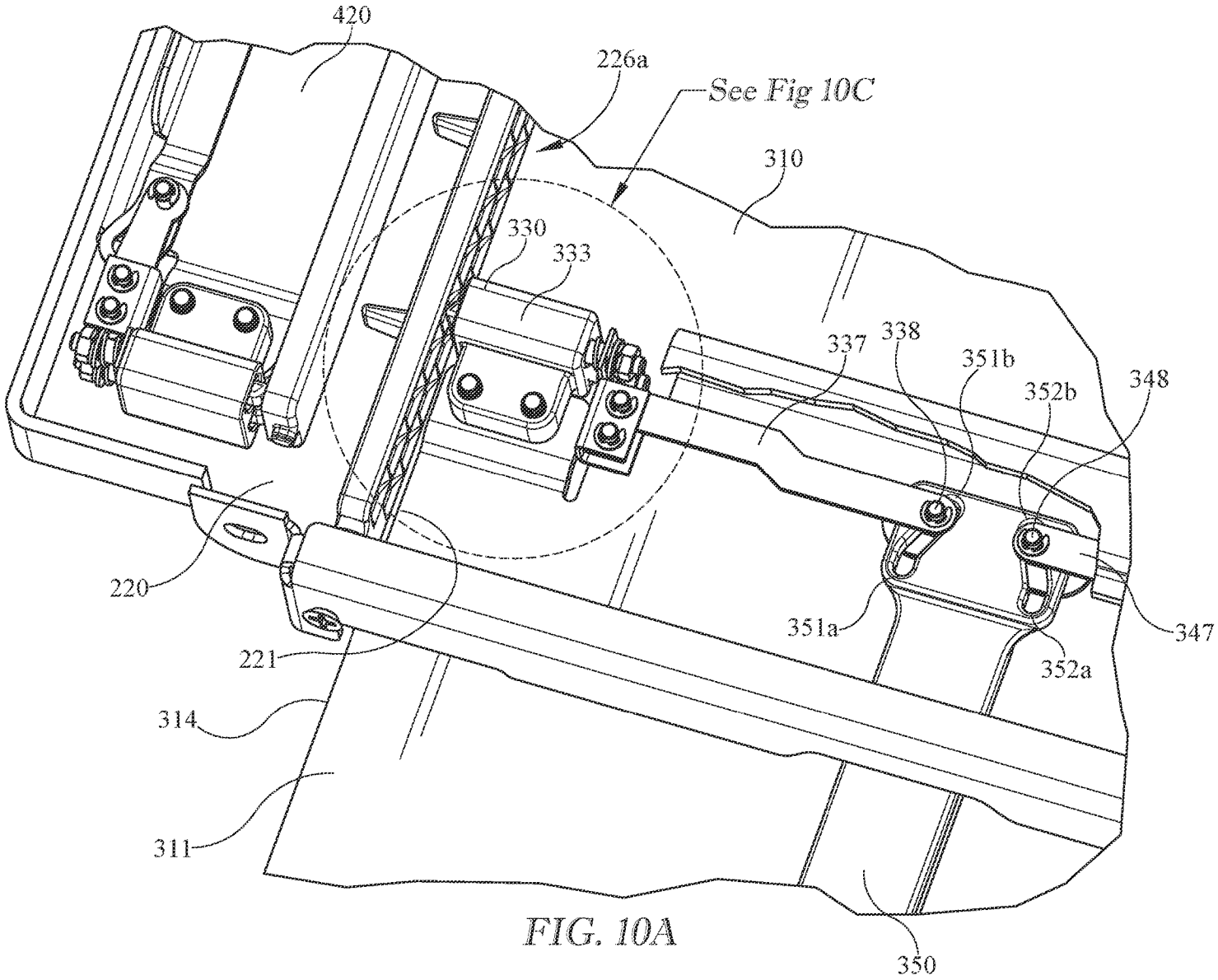
FIG. 10A is a partial cutaway view of the top of the bracket of FIG. 8, viewing a first pawl of the indoor portion.
Figure 10B:
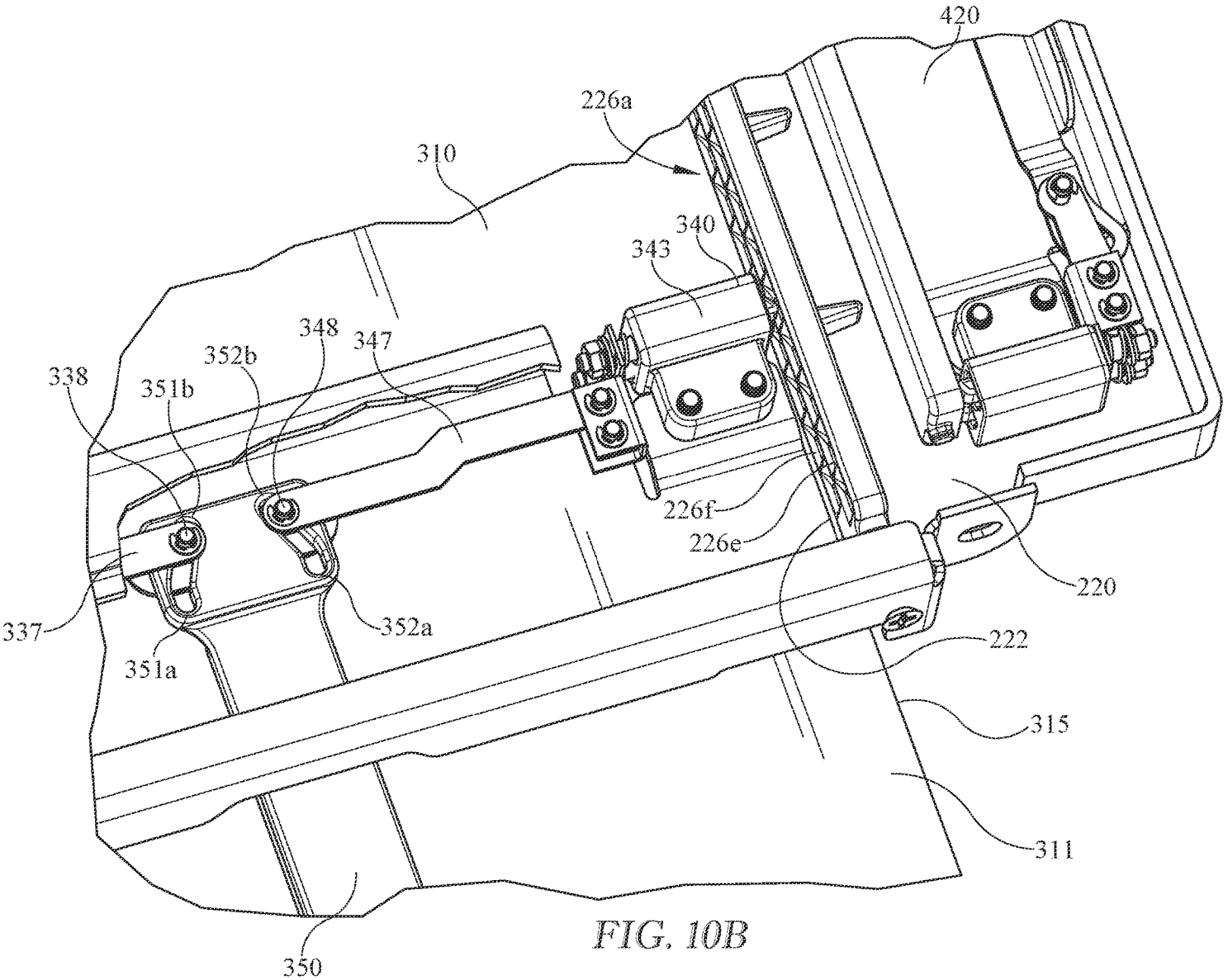
FIG. 10B is a partial cutaway view of the top of the bracket of FIG. 8, viewing a second pawl of the indoor portion.
Figure 10D:
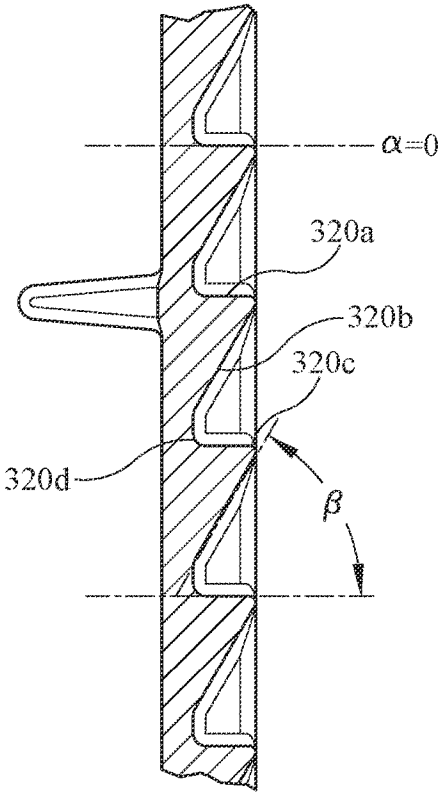
FIG. 10D is a section view taken at section line 10D-10D of FIG. 10C.
Figure 10C:
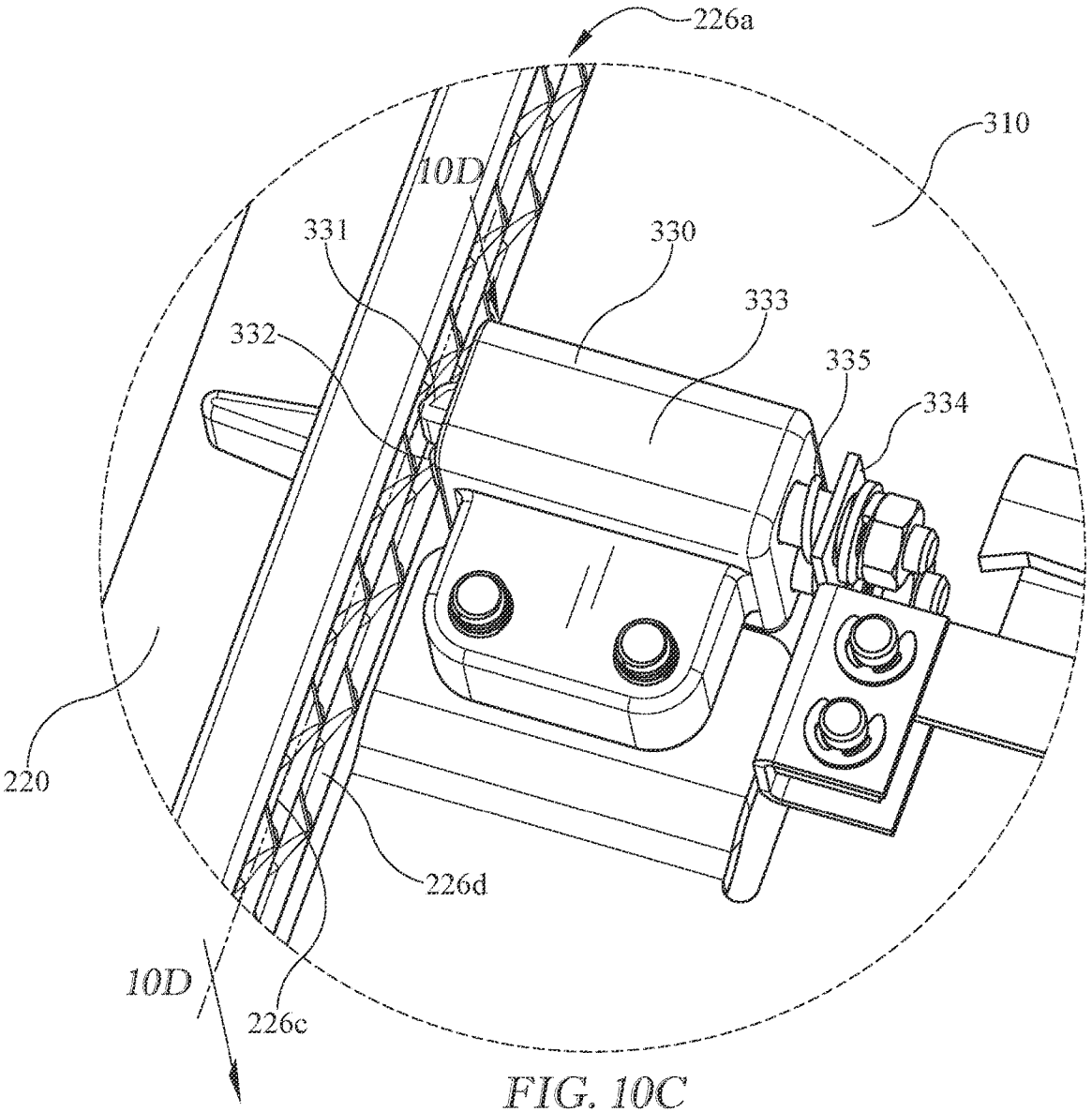
FIG. 10C is a close up view of the interaction between pawls and ratchet teeth according to an embodiment.

Referring now to FIGS. 8-9, the first leg 311 of the sliding base 310 includes a first side 314 and a second side 315. One or more pawls is provided on the sliding base 310. As shown in FIGS. 10A and 10B, a first pawl 330 is coupled at the first side 314 and a second pawl 340 is coupled at the second side 315. In general, the first pawl 330 is configured to interact with the first row 226*a* of ratchet teeth and the second pawl 340 is configured to interact with the second row 226*b* of ratchet teeth. As shown in FIGS. 10A and 10C, first pawl 330 includes upper pawl 331 and lower pawl 332, and second pawl 340 includes upper pawl 341 and lower pawl 342. In this embodiment, upper pawl 331 is configured to interact with upper row 226*c* and lower pawl 332 is configured to interact with lower row 226*d*. Likewise, upper pawl 341 is configured to interact with upper row 226*e* and lower pawl 342 is configured to interact with 226*f*.

The upper pawl 331 and lower pawl 332 are coupled to the first leg 311 within a pawl housing 333. The pawl housing 333 includes a spring base 334 against which a spring 335 can interact. Each of the upper pawl 331 and lower pawl 332 includes a feature, such as ledge 336, to couple with the spring 335 so that spring 335 can impart a spring bias force on the pawl. Likewise, the upper pawl 341 and lower pawl 342 are coupled to the first leg 311 within a pawl housing 343. The pawl housing 343 includes a spring base 344 against which a spring 345 can interact. Each of the upper pawl 341 and lower pawl 342 includes a feature, such as ledge 346, to couple with the spring 345 so that spring 345 can impart a spring bias force on the pawls.

Referring again to FIG. 10A, the pawls 331, 332 are slideably moveable, under a spring bias force, within pawl housing 333. In particular, the pawls 331, 332 are coupled to an arm 337. The arm 337 is coupled to a pin 338 that is capable of moving (ie. sliding) only in single complementary (back and forth) direction—that is, sliding in a left/right direction. In FIG. 10A, the spring 335 biases the pin 338 (and therefore, the arm 337) toward the left direction.

Referring again to FIG. 10B, similarly, the pawls 341, 342 are slideably moveable, under a spring bias force, within pawl housing 343. In particular, the pawls 341, 342 are coupled to an arm 347. The arm 347 is coupled to a pin 348 that is capable of moving (ie. sliding) only in single complementary (back and forth) direction—that is, sliding in a left/right direction. In the FIG. 10B, the spring 345 biases the pin 348 (and therefore, the arm 347) toward the right direction.

The sliding base 310 is slideable into/out of the indoor slide base 220. In particular, the first leg 311 is translatable into and out of the indoor slide base 220 of base 200. With continuing reference to FIGS. 8, 9, 10A, 10B, and 10C, the first leg 311 further includes a ratchet release handle 350 slideably coupled to the first leg 311 at pins 338, 348. In the embodiment shown, the ratchet release handle 350 includes a slot 351 and a slot 352. Slot 351 includes a first end 351*a* and a second end 351*b*. Slot 352 similarly includes a first end 352*a* and a second end 352*b*. Slot 351 slideably receives therein pin 338. Slot 352 slideably receives therein pin 348. In this manner the ratchet release handle 350 is coupled to the arm 337 and the arm 347. Other forms of connection and/or keying of the ratchet release handle 350 to the arms 337, 347, respectively, are contemplated, including but not limited to rotary motion, cams, gears, other physical attachment, and the like.

As discussed above, arm 337 is coupled to the first pawl 330 (upper pawl 331 and lower pawl 332). Ratchet release handle 350 is translatable in a first complementary direction (that is, in the figures, front/back or in/out). In FIGS. 10A and 10B, the ratchet release handle 350 is shown after having been moved in a first direction (downwardly in the figures). Spring 335 biases first pawl 330 (or in the embodiment shown, upper pawl 331 and lower pawl 332) into an extended position. In FIG. 10A, this extended position is when the first pawl 330 (upper pawl 331 and lower pawl 332) is toward the left. Because the ratchet release handle 350 is coupled to the arm 337 via pin 338, the spring bias force of spring 335 biases the ratchet release handle 350 into a retracted (or, second) position (in the figures, the retracted position of the ratchet release handle 350 is toward the window sill). This configuration naturally tends to place pin 338 into the first end 351*a* of slot 351. Slot 351 is oriented at an angle with respect to the longitudinal motion of the ratchet release handle 350 such that moving ratchet release handle 350 from its retracted position toward its extended position moves the slot 351 relative to the pin 338, such that pin 338 moves from the first end 351*a* of slot 351 to the second end 351*b* of slot 351. Because second end 351*b* of slot 351 is located farther from the first side 314 than is first end 351*a* of slot 351, moving the pin 338 into the second end 351*b* results in pulling arm 337 against the spring bias force of spring 335. This results in removing the first pawl 330 (upper pawl 331 and lower pawl 332) from engagement with the first row 226*a* (upper row 226*c* and lower row 226*d*, respectively).

Similarly, arm 347 is coupled to the second pawl 340 (upper pawl 341 and 342). Ratchet release handle 350 is translatable in a first complementary direction (that is, in the figures, front/back or in/out). Spring 345 biases second pawl 340 (or in the embodiment shown, upper pawl 341 and lower pawl 342) into an extended position. In the figures, this extended position is when the second pawl 340 (upper pawl 341 and lower pawl 342) is toward the right. Because the ratchet release handle 350 is coupled to the arm 347 via pin 348, the spring bias force of spring 345 biases the ratchet release handle 350 into a retracted position (in the figures, the retracted position of the ratchet release handle 350 is toward the window sill). This configuration naturally tends to place pin 348 into the first end 352*a* of slot 352. Slot 352 is oriented at an angle with respect to the longitudinal motion of the ratchet release handle 350 such that moving ratchet release handle 350 from its retracted position toward its extended position moves the slot 352 relative to the pin 348, such that pin 348 moves from the first end 352*a* of slot 352 to the second end 352*b* of slot 352. Because second end 352*b* of slot 352 is located farther from the second side 315 than is first end 352*a* of slot 352, moving the pin 348 into the second end 352*b* results in pulling arm 347 against the spring bias force of spring 345. This results in removing the second pawl 340 (upper pawl 341 and lower pawl 342) from engagement with the second row 226*b* (upper row 226*e* and lower row 226*f*, respectively).

Referring again to FIGS. 10A, 10B, and 10C, the first row 226*a* of ratchet teeth is linearly arranged at the first side 221 of indoor slide base 220. The second row 226*b* of ratchet teeth is linearly arranged at the second side 222 of indoor slide base 220. With reference now to FIG. 10D, each ratchet tooth 320 includes a first surface 320*a* and a second surface 320*b* joined at ridge 320*c*. Each adjacent ratchet tooth 320 is joined by a valley 320*d*. The first surface 320*a* is disposed at a first angle, alpha, measured counterclockwise in FIG. 10D at a valley and with respect to a horizontal plane, of approximately 0 degrees. However, the first surface 320*a* could take on a range of angles, from approximately −5 degrees to approximately 5 degrees (as oriented in FIG. 10D). The second surface 320*b* is disposed at a second angle, beta, measured counterclockwise in FIG. 10D at a valley and with respect to a horizontal plane, of approximately 30 degrees. However, the second surface 320*b* could take on a range of angles, from approximately 20 degrees to approximately 45 degrees. The first pawl 330 has a body 330*a* and a free end 330*b*. The second pawl 340 has a body 340*a* and a free end 340*b*. This same shape of pawl (that is, with a body and a free end) holds true for embodiments including upper pawls 331, 341 and lower pawls 332, 342, respectively. As with typical pawls/ratchet arrangements, the pawls 330, 340 are spring biased in a given direction. In the embodiment shown, this spring bias force is provided in a given translational direction by spring 335, 345, respectively. As best seen in FIG. 10A, the spring bias force tends to make the ratchet release handle 350 reside in its retracted position. That is, to overcome the spring bias force, the ratchet release handle 350 must be physically moved (translated) toward an extended position.

The rows of ratchet teeth 226*a*, 226*b* and, if present, 226*c*, 226*d*, 226*c*, and 226*f* are arranged such that the indoor sliding base 310 can translate in one direction by simply pushing the indoor sliding base 310, but that the indoor sliding base 310 cannot freely translate in the opposite direction because the free ends 330*b*, 340*b* of the pawls 330, 340 are engaged in a valley 320*d* of respective ratchet teeth 226 and interfere with the first surface 320*a*. When it is desired to decrease the size of the open space 20, the sliding base 310 is pushed toward the indoor slide base 220 and the first pawl 330 and second pawl 340 simply ride on each ratchet tooth 226 and move into successive valleys 320*d*. The springs 335, 345 provide the bias force to move the free ends 330*b*, 340*b*, respectively into each valley 320*d*. However, when it is desired to increase the size of the open space 20, the sliding base 310 cannot simply be freely pulled away from the indoor slide base 220. Rather, in order to translate the sliding base 310 in a direction away from the indoor slide base 220, a physical force is imparted to the ratchet release handle 350 in a direction opposing the spring bias force, and for a distance great enough to enable the free ends 330*b*, 340*b* to escape the ratchet teeth 320 (for example, to allow the free ends 330*b*, 340*b* to move laterally beyond the ridge 320*c*). This is done by pulling ratchet release handle 350 to move pin 338 from the first end 351*a* of slot 351 to the second end 351*b*, and also to move pine 348 from the first end 352*a* of slot 352 to the second end 352*b*. Once the free ends 330*b*, 340*b* are out of engagement with the ridges 320*c*, the sliding base 310 can be pulled away from the indoor slide base 220, thus increasing the size of the open space 20.

The outdoor portion 400 is also adjustable with respect to the base 200. With reference to FIGS. 8, 9, 10A, and 11, the base 200 includes an outdoor slide retainer 227 and the outdoor portion 400 includes one or more outdoor rails 410. The outdoor rails 410 can slide within the outdoor slide retainer 227. The outdoor rails 410 have multiple fastener openings 411 that can be slid to align with corresponding fastener openings 228 in the outdoor slide retainer 227. Once the desired configuration of the outdoor rails 410 and outdoor slide retainer 227 is achieved, one or more fasteners can be inserted through fastener openings 228, 411, respectively, to securely couple the outdoor rails 410 to the outdoor slide retainer 227.

Figure 11:
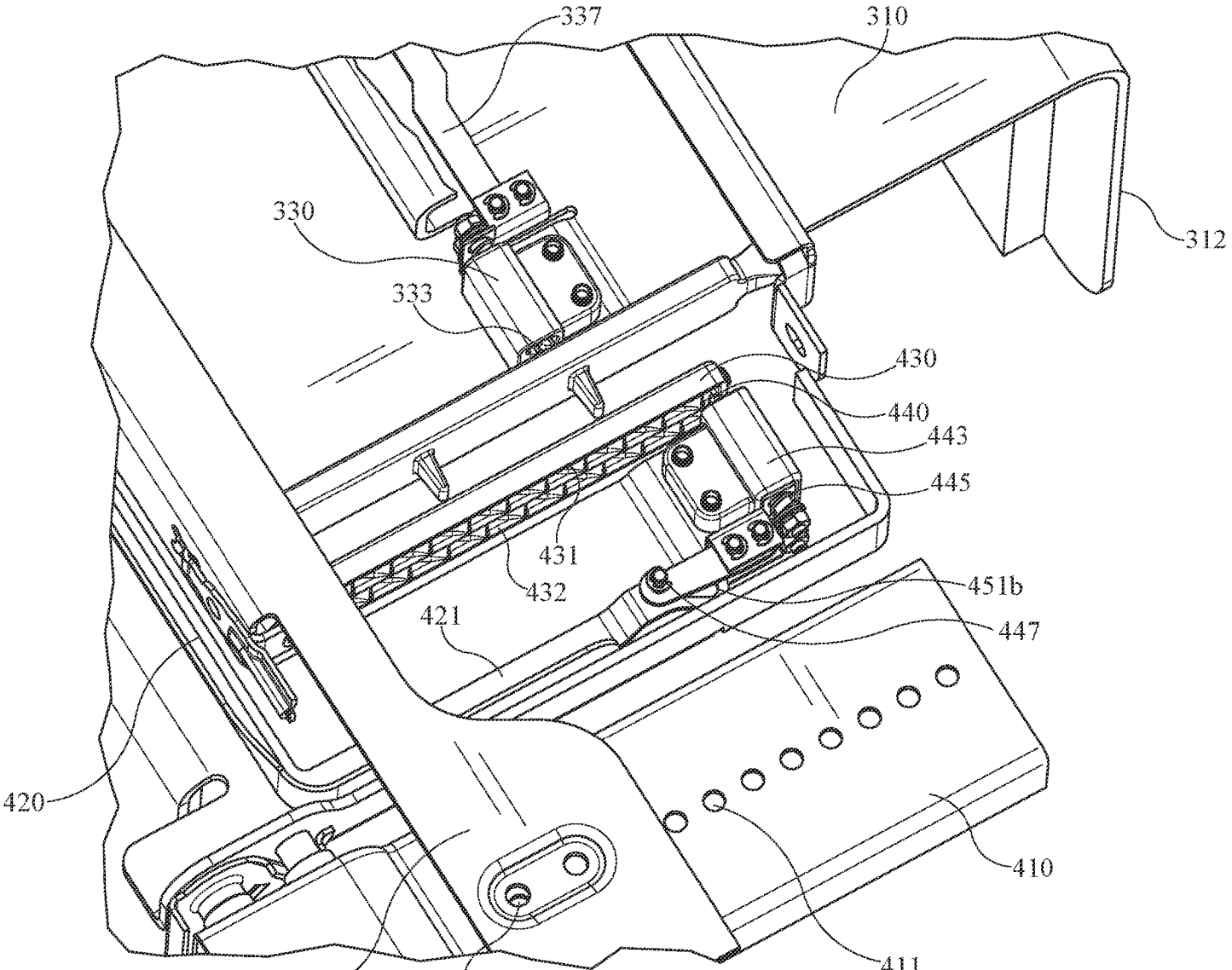
FIG. 11 is a partial cutaway view of the top of the bracket of FIG. 8, viewing a first pawl of the outdoor portion.
Figure 12:
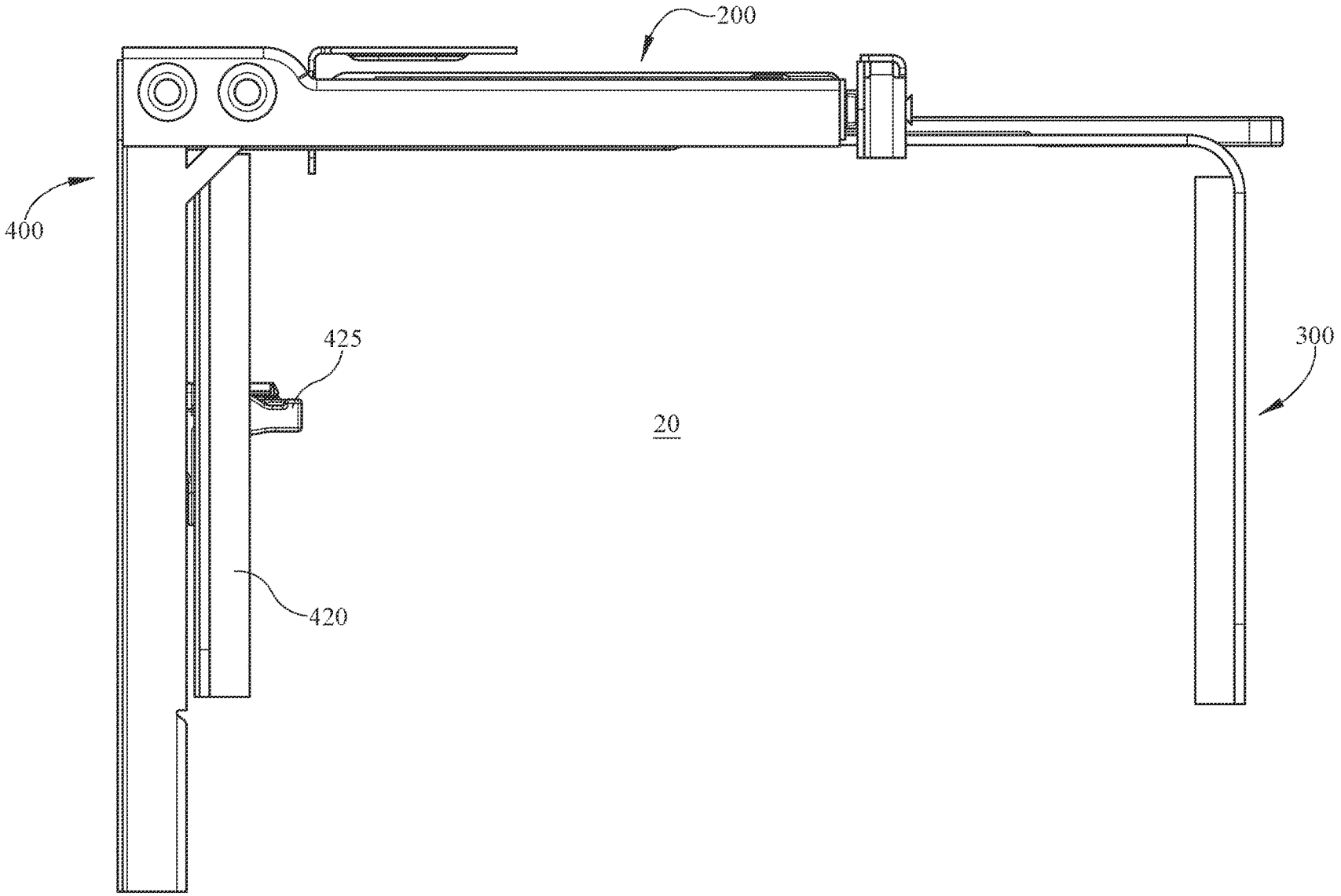
FIG. 12 is a side elevation view of the bracket of FIG. 8, with the indoor portion of the bracket in a retracted position.
Figure 13:
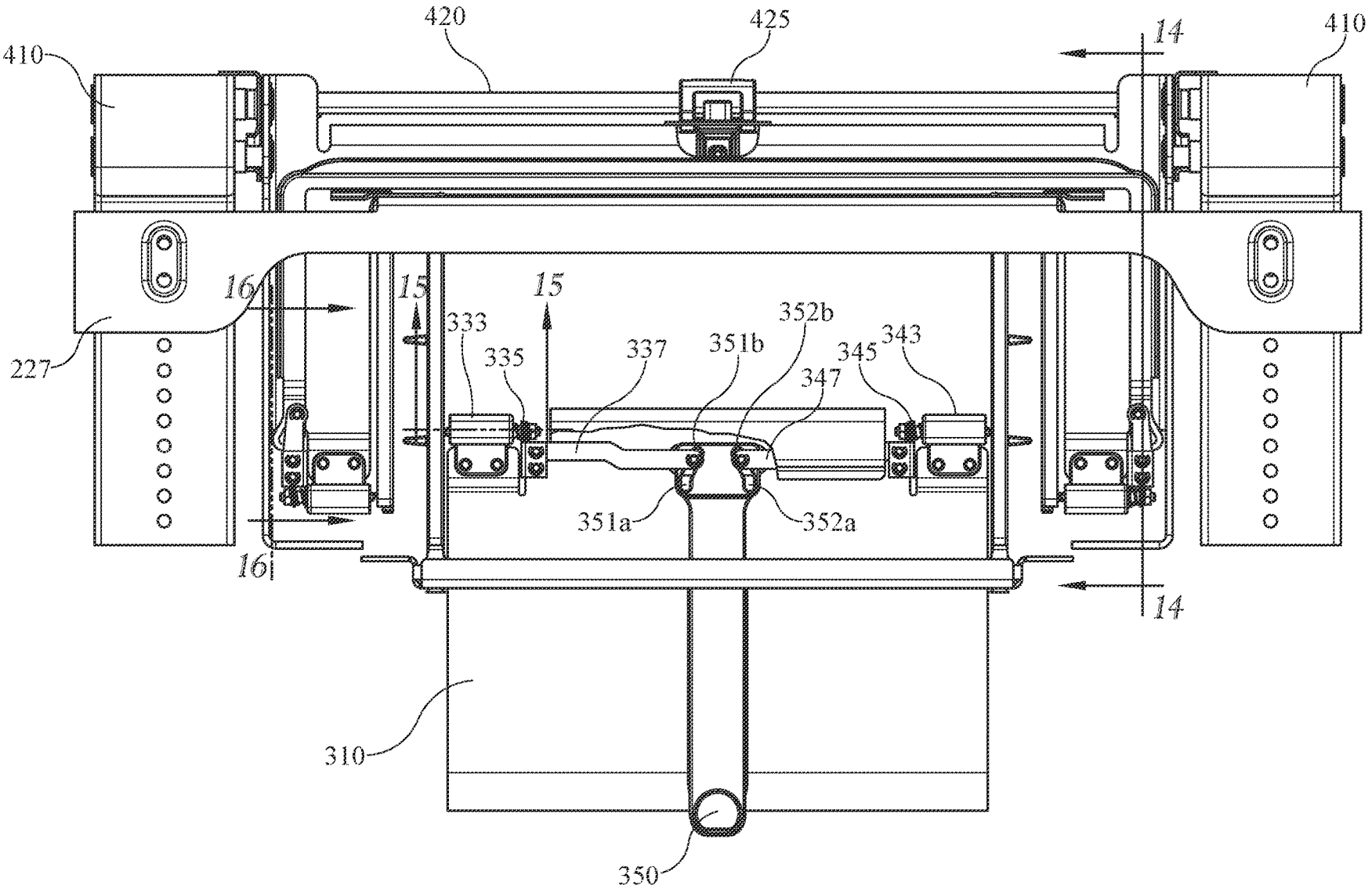
FIG. 13 is a top partial cutaway view of the bracket of FIG. 8.

Additionally, the outdoor portion 400, as discussed, includes an outdoor slide 420 that is adjustably slideable within the base 200 with similar ratchet/pawl mechanism as is coupled to the indoor portion 300 (see FIG. 11). The outdoor slide 420 takes on a basically U-shaped configuration, having a first leg 421, a second leg 422, and a third leg 423. The second leg 422 also serves as a release for the spring bias force acting on the outdoor portion 400 as will be described below. This shape is advantageous because when the overall bracket 100 is in its most compact configuration (that is, when both the indoor portion 300 and the outdoor portion 400 are fully retracted), the three legs 421, 422, and 423 can envelop or surround the sliding base 310, thus allowing for a more compact configuration. The outdoor slide 420 further includes a depending portion 424 that depends downwardly from the second leg 422. The depending portion 424 further includes an adjustable vertical support 425. The adjustable vertical support 425 serves to help prevent tipping of the bracket 100 by being adjustable in vertical position such that the adjustable vertical support 425 can sit firmly on the outdoor sill of the window. Once the adjustable vertical support 425 is placed in contact with the outdoor sill, the outdoor portion 400 provides additional constraint for the bracket itself. The A/C unit can then be placed atop the platform 210 and outdoor portion 400.

Figure 14:
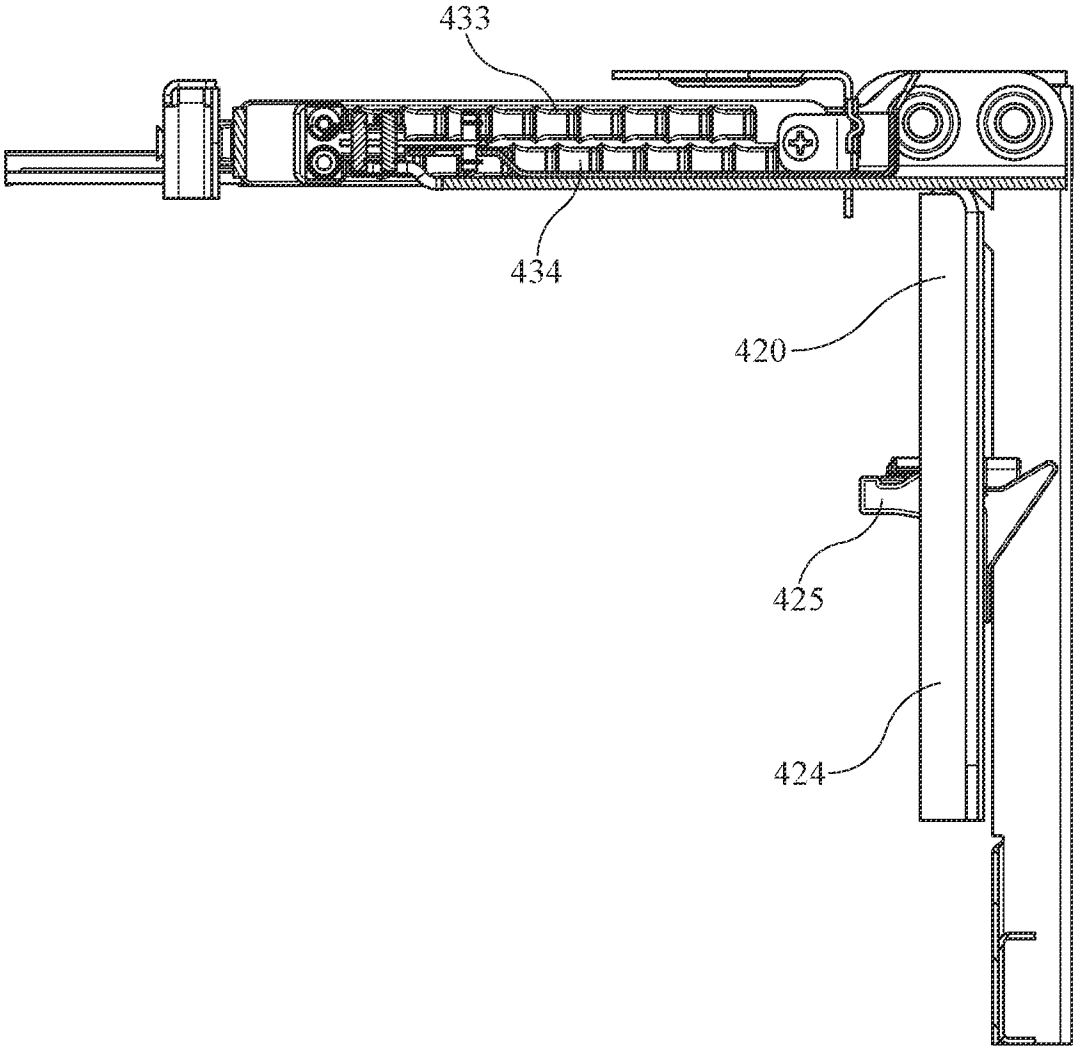
FIG. 14 is a section view taken at section line 14-14 of FIG. 13.
Figure 15:
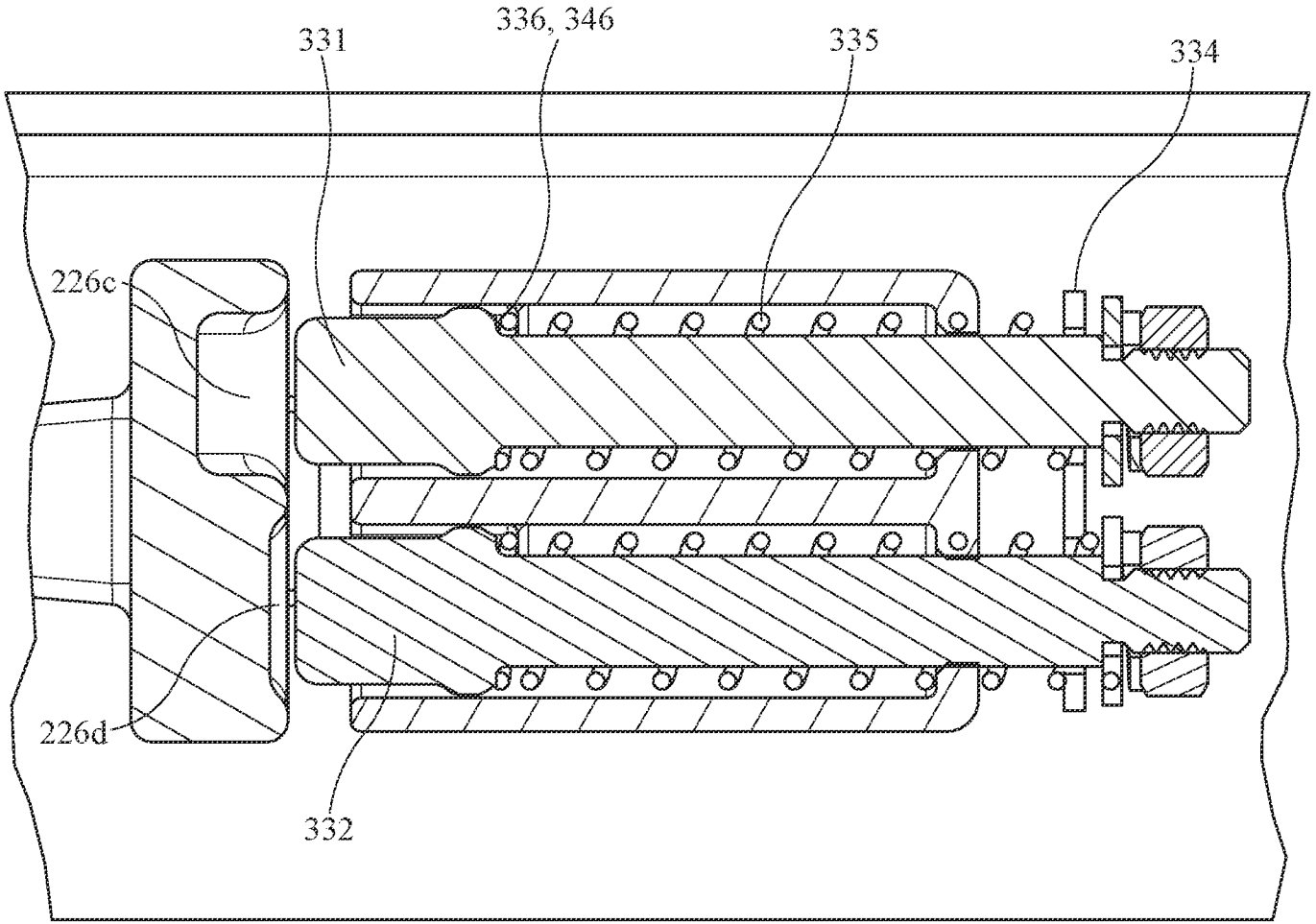
FIG. 15 is a section view taken at section line 15-15 of FIG. 13.
Figure 16:
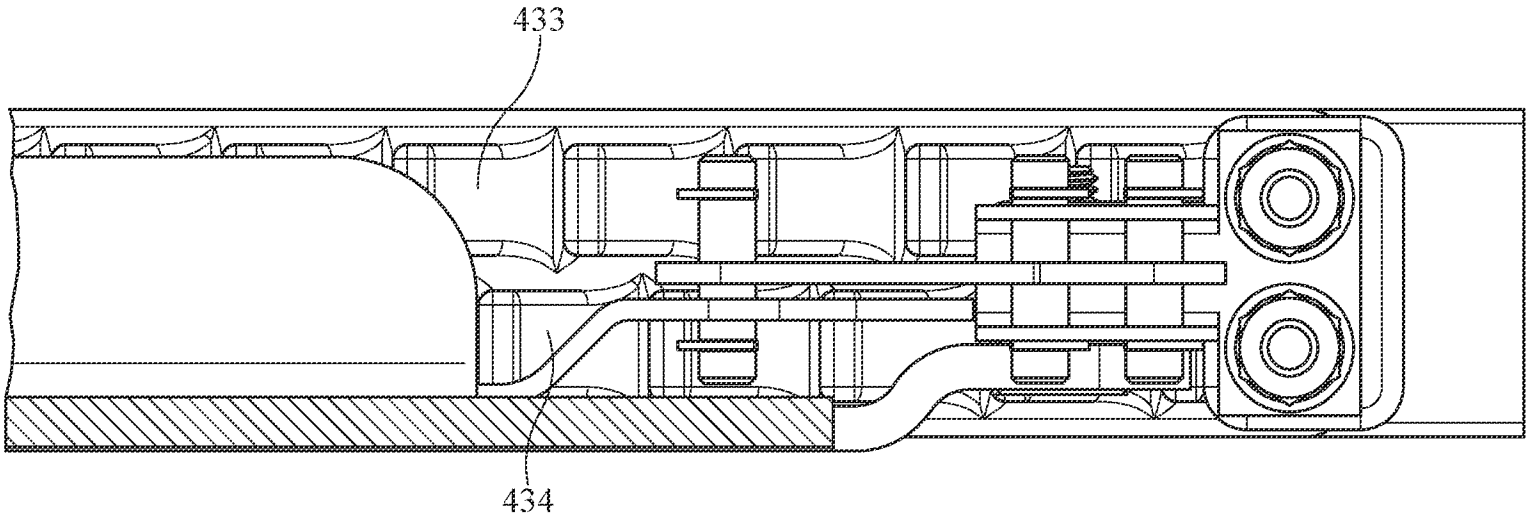
FIG. 16 is a section view taken at section line 16-16 of FIG. 13.

With reference to FIG. 11, the ratchet/pawl mechanism facilitating the sliding movement of the outdoor slide 420 is similar to the structures discussed above and shown in FIGS. 10A, 10B, and 10C with respect to the sliding base 310 sliding with respect to the indoor slide base 220. Therefore, an exhaustive repetition of the structures providing this functionality is not repeated here, but in general the base 200 includes at least one set of outdoor portion ratchet teeth 430. In the embodiment shown, the outdoor portion ratchet teeth 430 includes first upper row 431, first lower row 432 (FIG. 11), and second upper row 433, and second lower row 434 on the other side of the base 200 (FIG. 14). These ratchet teeth are similar in design to the teeth described above with respect to this embodiment, with the exception that the teeth are arranged in a directionally opposite direction from those of first row 226*a* and second row 226*b*. That is, the first surface 320*a* of ratchet teeth 430 faces in a direction opposite to that of first surface 320*a* of ratchet teeth 320. This is because the outdoor slide 420 is oriented 180 degrees from that of the indoor sliding base 310. Similarly, the outdoor slide 420 includes outdoor pawl 440 (only one is depicted in FIG. 11, but in the embodiment described an identical outdoor pawl 440 is present on the opposite side of the outdoor slide 420). The outdoor pawl 440 preferably, but need not, includes an upper pawl 441 and a lower pawl 442. These pawls 441, 442 are contained within outdoor pawl housing 443. Each of the upper pawl 441 and lower pawl 442 includes a feature, such as ledge 446, to couple with a spring 445 so that spring 445 can impart a spring bias force on the pawls. The pawl housing 443 includes a spring base 444 against which spring 445 can interact. The outdoor slide 420 acts as a ratchet release in a manner similar to that of ratchet release handle 350 described above. The first leg 421 is slideably coupled to the pawl housing 443 at pin 447 (FIG. 11). The second leg 423 is slideably coupled to the other outdoor pawl housing 443 (not shown) at pin 448. First leg 421 includes a slot 451. Third leg 423 includes a slot 452. Slot 451 includes a first end 451*a* and a second end 451*b*. Slot 452 similarly includes a first end 452*a* and a second end 452*b*. Slot 451 slideably receives therein pin 447. Slot 452 slideably receives therein pin 448. In this manner the outdoor slide 420 (via a user pushing or pulling second leg 422) acts to move the pins 447, 448 against the bias force of spring 445 from first end 451*a* to second end 451*b* of slot 451 and first end 452*a* to second end 452*b*, respectively. Because the first ends 451*a*, 452*a* and second ends 451*b*, 452*b* are disposed at different distances from the row of outdoor portion ratchet teeth 430 (that is, second ends 451*b*, 452*b* are located farther from the outdoor ratchet teeth 430 that are first ends 451*a*, 452*a*), this movement can move the outdoor pawls 440 into and out of engagement with the outdoor portion ratchet teeth, in a manner similar to that described above with respect to the indoor sliding base 310.

Other forms of connection and/or keying of the ratchet release to the pawl housing 443 are contemplated, including but not limited to rotary motion, cams, gears, other physical attachment, and the like.

The bracket 100 of this embodiment is advantageously designed to be installed in a window sill prior to installation of an air conditioner thereon. To install, the window sash is opened to expose the window sill. The bracket 100 is placed into a configuration that allows it to cover the window sill such that the open space 20 receives therewithin the wall supporting the window sill. This might include extending or retracting one or both of the indoor portion 300 and the outdoor portion 400. If the indoor portion 300 needs to be retracted, the sliding base 310 is simply pushed toward the indoor slide base 220 until the desired spacing is achieved. If the indoor portion 300 needs to be extended, the ratchet release handle 350 is pulled to move the pawls (any or all of 330, 331, 332, 340, 341, 342) out of engagement with the respective rows of ratchet teeth 226. The sliding base 310 can then be extended to its desired position. Similarly, if the outdoor portion 400 needs to be retracted, the outdoor slide 420 is simply pushed toward the base 200 until the desired spacing is achieved. If the outdoor portion 400 needs to be extended, the outdoor slide 420 acts as a ratchet release by being pulled to move the pawls 441, 442 out of engagement with the respective rows of outdoor portion ratchet teeth 430. The outdoor slide 420 can then be extended to its desired position. As discussed above, the adjustable vertical support 425 of the depending portion 424 of the outdoor slide 420 is moved to its desired location at the top surface of the sill. Additionally, if desired, a rubber boot or other high friction member can also be added to the depending portion 424 to provide additional grip on the sill.

The indoor portion 300 can similarly be adjusted. To retract the indoor portion 300, a user simply pushes on the sliding base 310 toward the base 200 until the second leg 312 makes contact with the indoor wall beneath the sill. To extend the indoor portion 300, a user applies a force to the ratchet release handle 350 in a direction opposite the spring bias force of springs 335, 345 to remove the free ends 330*b*, 340*b* from engagement with the valleys 320*d* of the ratchet teeth 320. The indoor sliding base 310 can then be extended to the desired location. Then, the force being applied to the ratchet release handle 350 is removed, and the spring bias force then brings the free ends 330*b*, 340*b* of the first and second pawls 330, 340, respectively, into engagement with valleys 320*d* of the ratchet teeth 320. Now that the outdoor portion 400 and indoor portion 300 have been placed into their desired positions, an air conditioner can be placed atop, and secured to, if desired, the bracket 100.

The embodiment shown in FIGS. 8-16 provides benefits not found in the other embodiments herein. One benefit is a savings of space/size of the overall bracket 100. By providing the rows of ratchet teeth 226 within the indoor slide base 220 arranged as shown herein (namely, with the ridges 320*c* and valleys 320*d* having vertical axes), the overall width of the indoor portion 300 can be minimized. This allows, among other things, an ability to utilize the bracket 100 in smaller window openings. Further, by including an ability to have two sets of ratchet teeth rows at each of the first side 221 (namely, upper row 226*c* and lower row 226*d*) and second side 222 (namely, upper row 226*c* and lower row 226*f*), the entire construct can be made stronger, with larger and/or stronger pawls and larger and/or stronger ratchet teeth 226. Moreover, utilizing such a design can allow not only smoother adjustment of the size of the open space 20, but also more controlled and safer engagement between the pawls and the ratchet teeth. For example, the upper rows 226*c*. 226*e* and lower rows 226*d*, 226*f* can, if desired, be arranged in a staggered relationship such that full engagement of the free end one pawl in a valley (for example, free end 330*b* in valley 320*d*) does not coincide with full engagement of the free end of other pawls in other valleys (for example, free end 340*b* in a different valley 320*d*). This can provide a more refined adjustment and can also provide a more stable width adjustment, as more pawl/teeth engagements are possible in any given distance of travel of the sliding base 310 within the indoor slide base 220.

FIGS. 17-24 depict another embodiment of the bracket 100. The base 200 includes a platform 210 for being situated atop a window sill. The platform 210, when installed on a window sill, provides a generally horizontal surface on which an air conditioner, or a portion of an air conditioner, may be placed. The base 200 includes one or more indoor slide bases 220 and one or more outdoor rail receiving openings 212. In the embodiment shown, the indoor slide base 220 includes an indoor slide retainer 225. The indoor slide retainer 225 serves to retain within the base 200 the structures facilitating sliding movement of the indoor portion 300 with respect to the indoor slide base 220 of the base 200, as will be described below.

The indoor portion 300 includes a sliding base 310. The sliding base 310 of the depicted embodiment takes the shape of an "L" section, having a first leg 311 and a second leg 312. The second leg 312 joins the first leg 311 at approximately a 90-degree angle, depending downwardly. Instead of having a ratchet and pawl mechanism, the sliding base 310 includes a cam locking configuration to lock the indoor slide base 220 to the indoor slide base 220.

Figure 17:
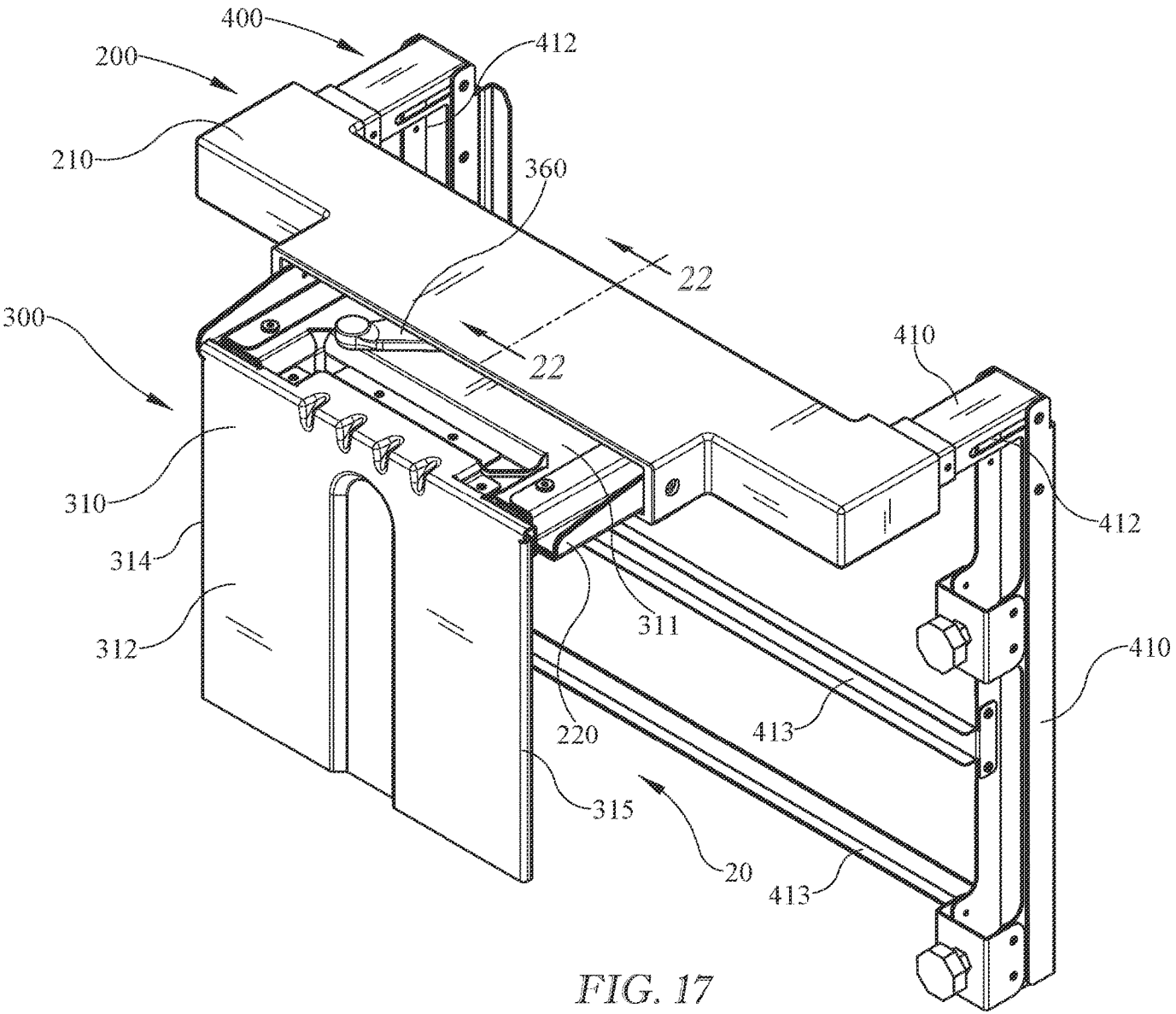
FIG. 17 is a top perspective view from an indoor viewing angle of another embodiment of the bracket, with the indoor portion of the bracket in a retracted position.
Figure 18:
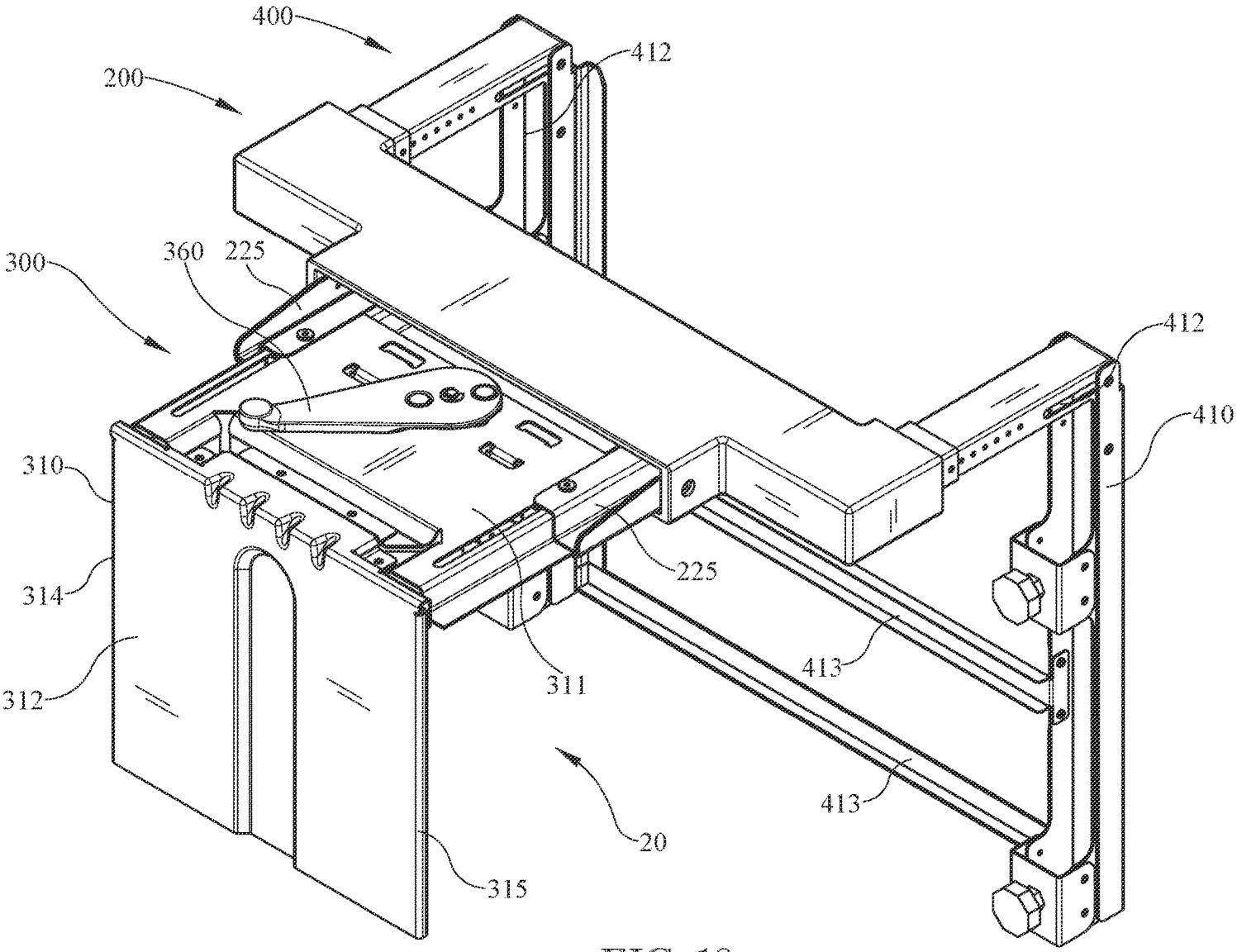
FIG. 18 is a top perspective view of the bracket of FIG. 17, with the indoor portion of the bracket in an extended position.
Figure 19:
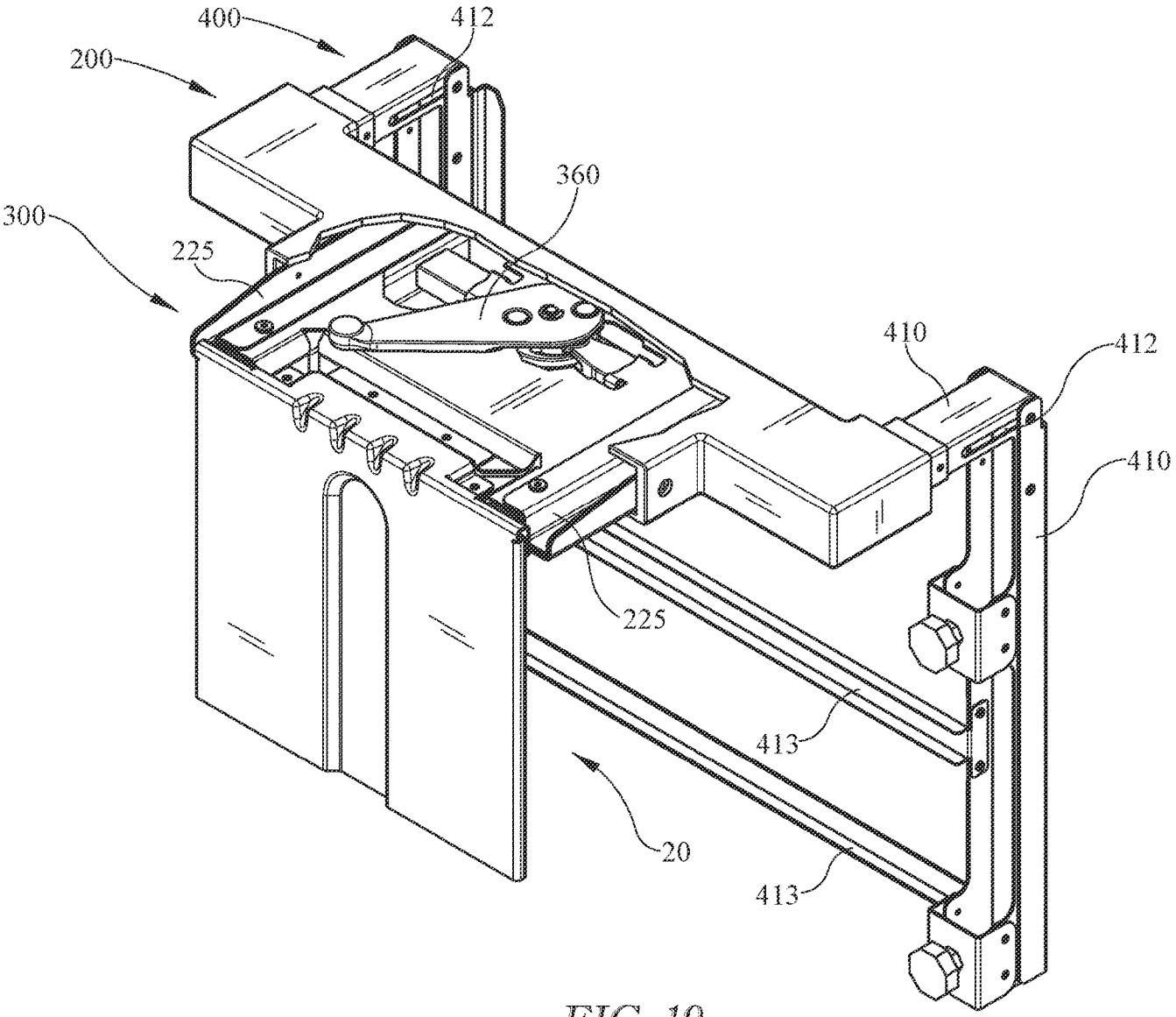
FIG. 19 is a top perspective partial cutaway view of the bracket of FIG. 17.
Figure 20:
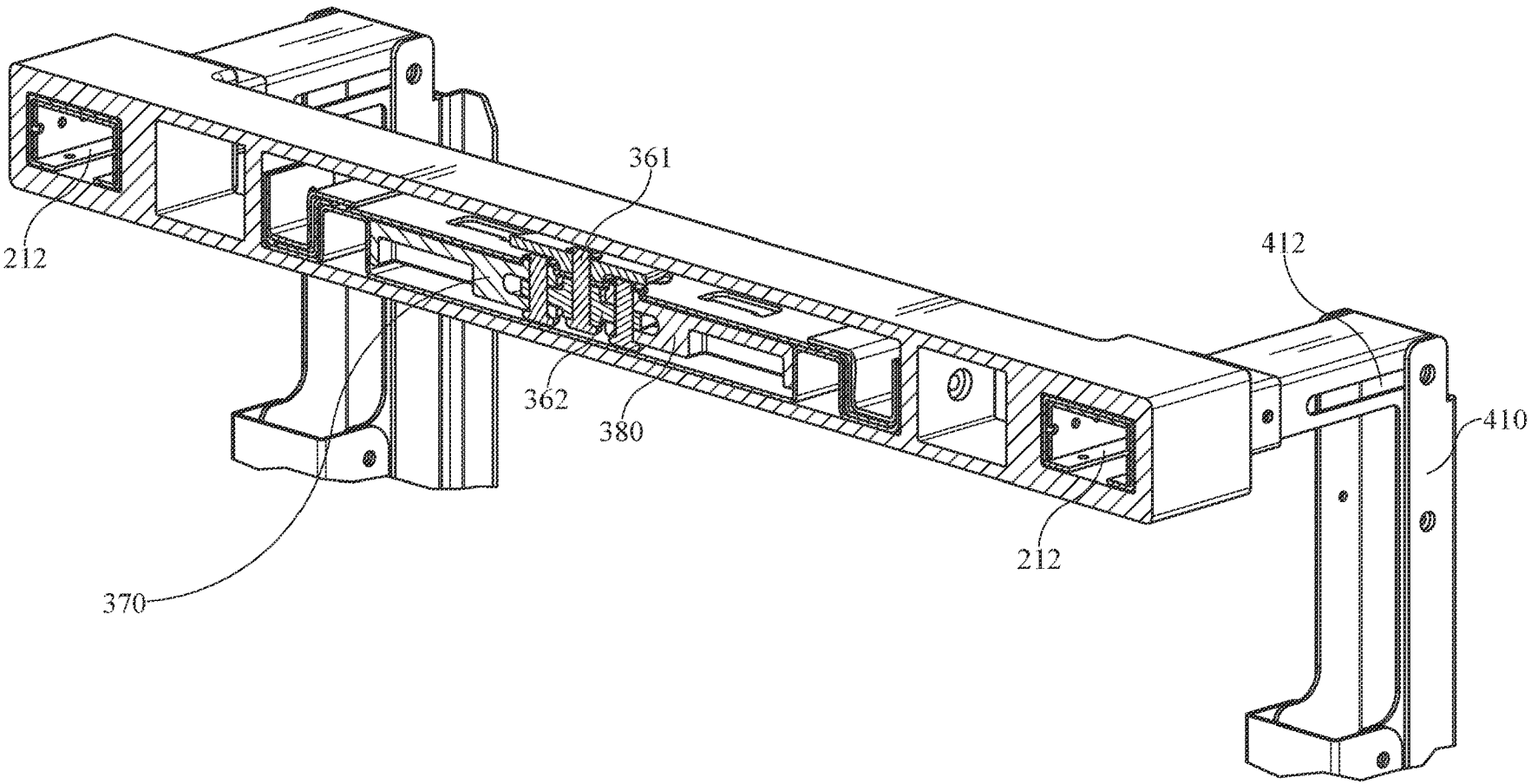
FIG. 20 is a top perspective partial section view from an indoor viewing angle of the bracket of FIG. 17.
Figure 21:
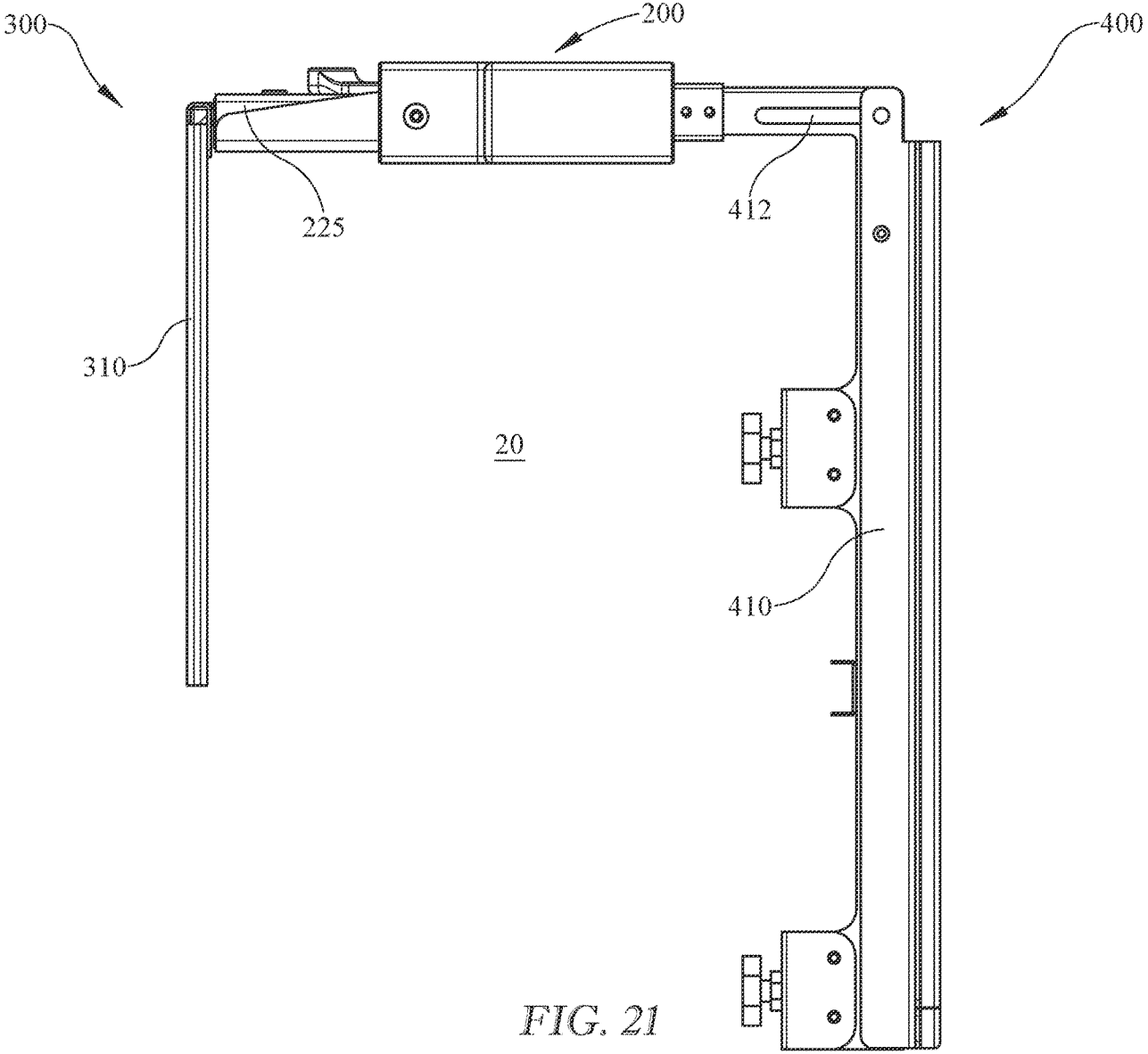
FIG. 21 is a side elevation view of the bracket of FIG. 17.
Figure 22:
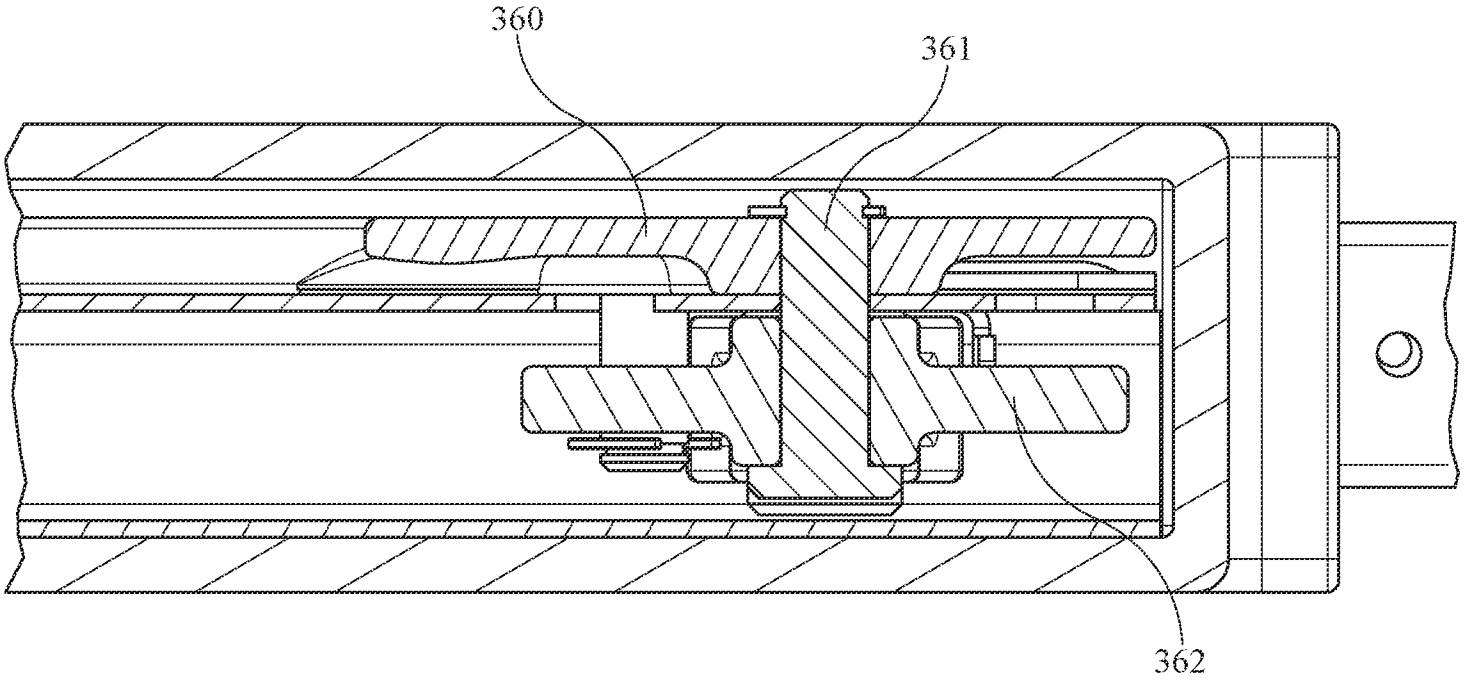
FIG. 22 is a section view of the locking wheel and locking cam of the bracket take at section line 22-22 of FIG. 17.
Figure 23:
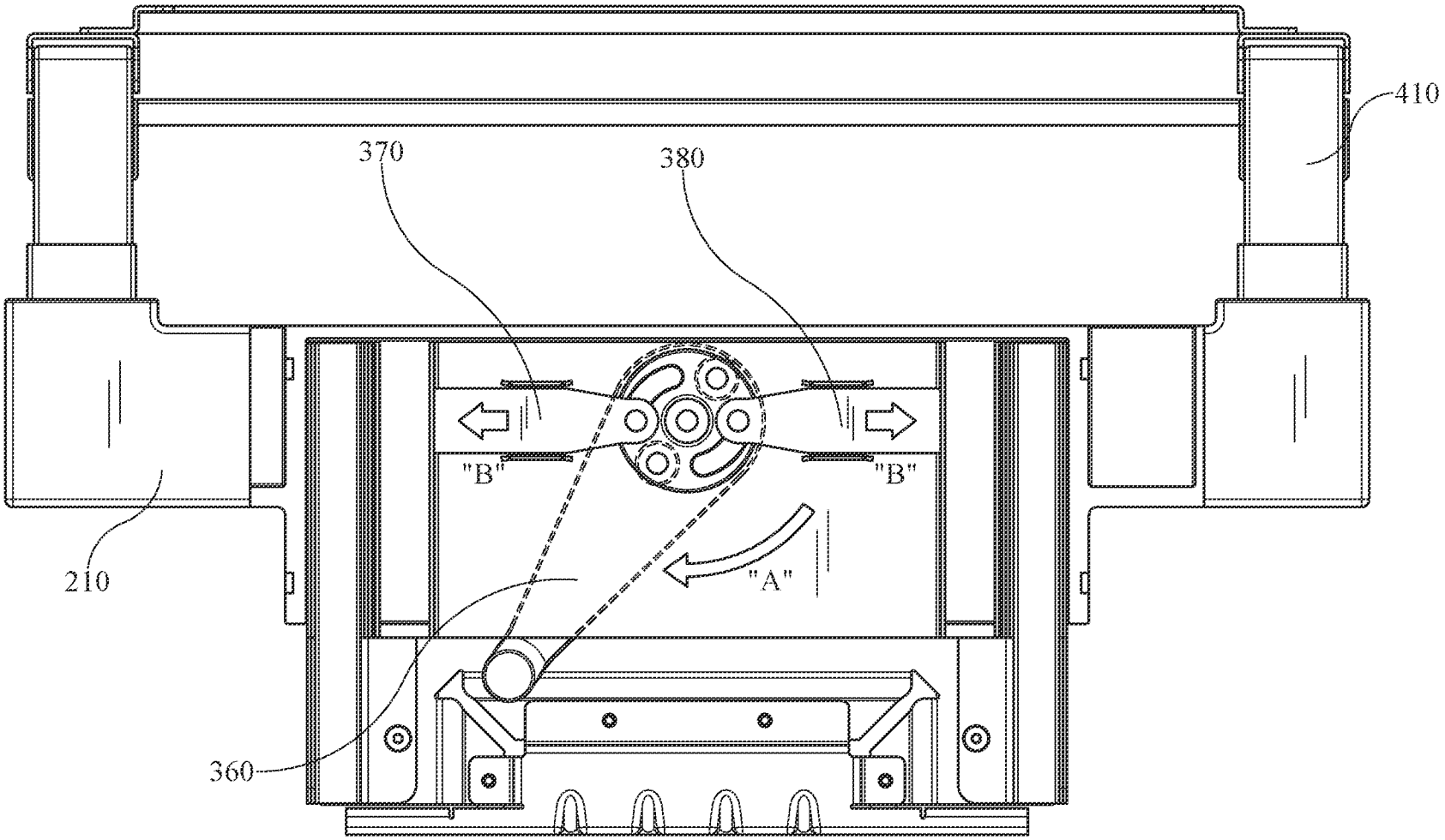
FIG. 23 is a top view of the bracket of FIG. 17 showing the locking handle in a locked position.
Figure 24:
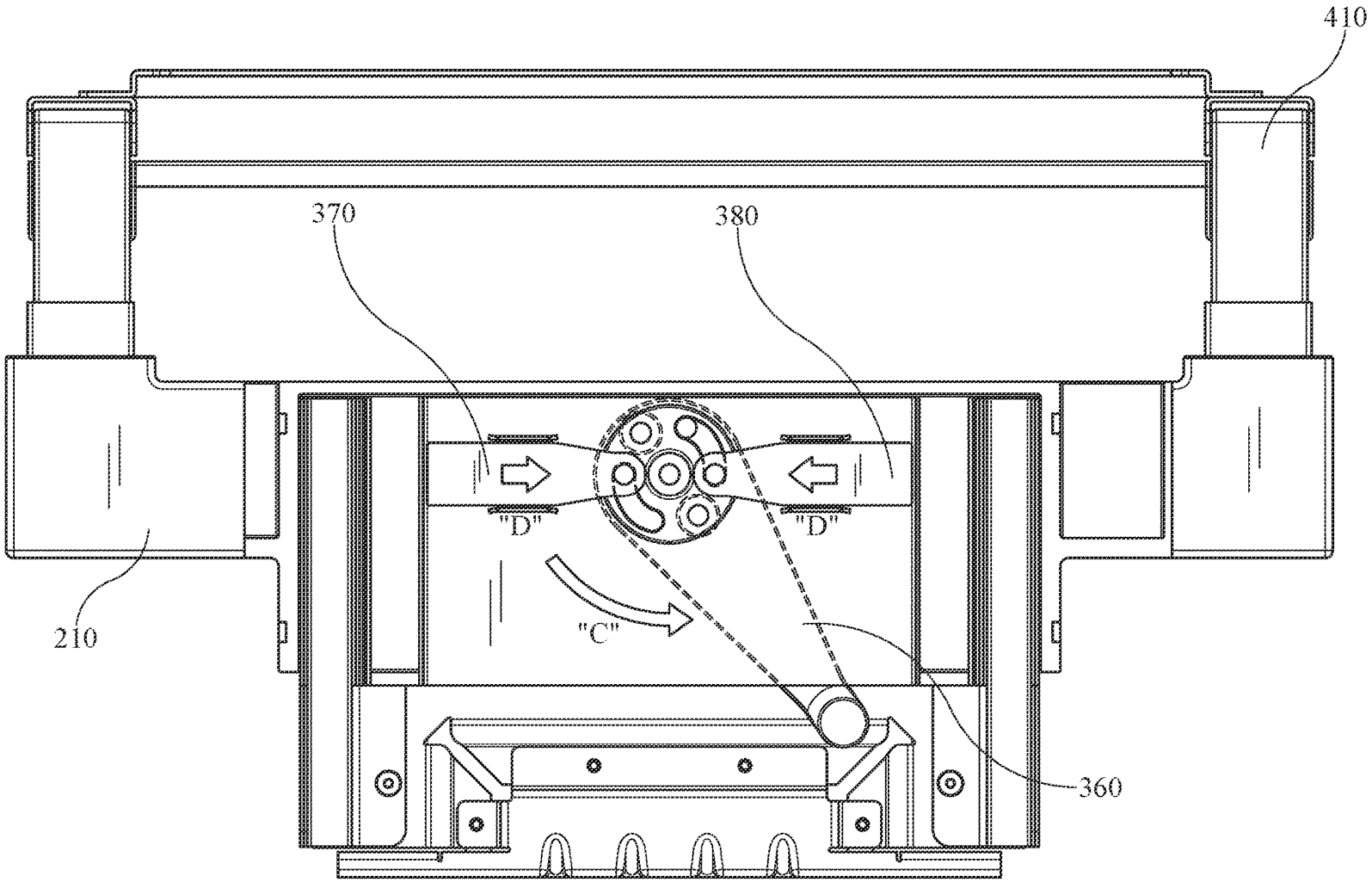
FIG. 24 is a top view of the bracket of FIG. 17 showing the locking handle in an unlocked position.

With reference to FIGS. 17-19, the first leg 311 of the sliding base 310 includes a first side 314 and a second side 315. A locking handle 360 is provided on the sliding base 310. The locking handle 360 is rotatable about an axis of its shaft 361. A locking wheel 362 is coupled to the shaft 361. The locking wheel 362 interacts with a first locking cam 370 and a second locking cam 380, as will be described. The locking wheel 362 includes openings 363 to receive fasteners 364 that couple the locking handle 360 to the locking wheel 362. The locking wheel 362 further includes a first slot 365 and a second slot 366. The first slot 365 receives therein a first cam pin 371 of first locking cam 370. The second slot 366 receives therein a second cam pin 381 of second locking cam 380. The first slot 365 and second slot 366 are arranged radially with an increasing distance from a centerline of the locking wheel 362 as the locking wheel 362 is rotated in a first direction. FIG. 23 depicts the locking handle 360 having been rotated in a first direction, labeled "A" in the figure. FIG. 24 depicts the locking handle 360 having been rotated in a second direction, labeled "C" in the figure. In FIG. 23, a user rotates the locking handle 360 in a first direction, which rotates the locking wheel 362 in the first direction. This makes a surface of the first slot 365 ride against the first cam pin 371 and a surface of the second slot 366 ride against the second cam pin 381. Because the first cam pin 371 is fixedly coupled to the first locking cam 370, this rotational movement of the locking wheel 362 (via locking handle 360) causes the first locking cam 370 to translate in the directions labeled "B" in the figure. In FIG. 23, the locking handle 360 has been rotated in the first direction ("A"), which causes the second end 373 of the first locking cam 370 to move into closer contact with (that is, in increasing pressure against) a surface of the indoor slide base 220. In this manner, the first side 314 of the sliding base 310 is pressed into close contact with the indoor slide base 220. Similarly, the locking handle 360 causes the second end 383 of the second locking cam 380 to move into closer contact with (that is, in increasing pressure against) a surface of the indoor slide base 220. In this manner, the second side 315 of the sliding base 310 is pressed into close contact with the indoor slide base 220.

Relatedly, in the configuration shown in FIG. 24, the locking handle 360 has been rotated in a second direction (labeled "C") (opposite of the first direction), which causes the second end 373 of the first locking cam 370 to move in direction labeled "D" away from a surface of the indoor slide base 220. In this manner, the first side 314 of the sliding base 310 is removed from contact with the indoor slide base 220. Similarly, the locking handle 360 causes the second end 383 of the second locking cam 380 to move in direction "D" away from a surface of the indoor slide base 220. In this manner, the second side 315 of the sliding base 310 is removed from contact with the indoor slide base 220.

The outdoor portion 400 is also adjustable with respect to the base 200 in a fashion similar to that shown in the embodiment of FIGS. 1-7. In particular (as shown in FIGS. 3 and 4 and 17-24), rail receiving openings 212 are located in the base 200 and are configured to receive therein outdoor rails 410 of the outdoor portion 400. The outdoor rails 410 can have fastener openings 411 that can facilitate coupling the adjustment structure 412 to rails that extend out of the base 200. Alternatively, or additionally, the outdoor rails 410 can have adjustment structures 412 to facilitate sliding adjustment of the outdoor portion 400 with respect to the base 200. Such adjustment structures 412 can include, but are not limited to: openings for fasteners; pins/slots; ball detents/openings; and the like. Each outdoor rail 410 is rotatable such that the outdoor rail 410 can be moved from a first configuration where the outdoor rail 410 is substantially parallel to the platform 210 to a second configuration where the outdoor rail 410 is substantially perpendicular to the platform 210. Once the desired configuration of the outdoor rails 410 is achieved, one or more fasteners can be inserted through fastener openings 228, 411, respectively, to securely couple the outdoor rails 410 to the base 200. FIGS. 1-3 depict the outdoor rails 410 after they have been moved from their first configuration to their second configuration. The outdoor portion 400 also can include one or more cross bars 413 connecting each outdoor rail 410. Additionally, one or more feet 414 are coupled to the outdoor rails 410. The feet 414 can be used to help secure or stabilize the outdoor portion 400 against an exterior wall.

The bracket 100 of this embodiment is advantageously designed to be installed in a window sill prior to installation of an air conditioner thereon. To install, the window sash is opened to expose the window sill. The bracket 100 is placed into a configuration that allows it to cover the window sill such that the open space 20 receives therewithin the wall supporting the window sill. Once the desired location and orientation of the bracket 100 has been achieved, the bracket 100 is secured to the window sill by inserting fasteners through the fastener openings 211 of the base 200. This might include extending or retracting one or both of the indoor portion 300 and the outdoor portion 400. If the indoor portion 300 needs to be retracted, the locking handle 360 is rotated to its unlocked position (see "C" in FIG. 24) and sliding base 310 is simply pushed toward the indoor slide base 220 until the desired spacing is achieved. If the indoor portion 300 needs to be extended, when the locking handle 360 is in position "C", the sliding base 310 is simply pulled away from the indoor slide base 220. Once the indoor portion 300 is situated as desired, the user can move the locking handle 360 to the locked position, in the direction "A" of FIG. 23. This locks the indoor portion 300 with respect to the base 200. Similarly, if the outdoor portion 400 needs to be retracted or extended, the adjustment structure 412 is manipulated to allow retraction/extension of the outdoor rails 410. This can involve, as but a couple examples, releasing pins or removing fasteners from fastener openings 411. The outdoor rails 410 can then be retracted/extended to its desired position. Then the adjustment structure 412 can be manipulated to lock the position of the outdoor rails 410 (e.g., by inserting pins or fasteners into fastener openings 411). The indoor portion 300 and outdoor portion 400 are then finally adjusted, if needed, to properly and safely arrange the bracket 100 such that the air conditioner to be placed thereon is properly supported. If any additional adjustments to the indoor portion 300 or the outdoor portion are desired, each can be moved to its desired position as described above.

One of the benefits of this embodiment is that, regardless of whether the size of the open space 20 is desired to be increased or decreased, there are no pawls/ratchets involved in either direction of travel of the sliding base 310. The locking handle 360 is simply rotated to its unlocked position, and the sliding base 310 can be moved toward the indoor slide base 220 or away from it by simply pushing/pulling the sliding base 310. The absence of ratchets/pawls also means that the amount of adjustment is infinite, with no set stop positions between the retracted position of the sliding base 310 and the extended position of the sliding base 310. Additionally, this embodiment reduces the time needed to install the bracket 100.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. An adjustable bracket for a window air conditioner comprising:

a base having a platform and an indoor slide base, said base configured to reside atop a sill of a window such that said platform is approximately horizontally disposed once said bracket is installed at a window sill, said indoor slide base coupled to said platform and having a pawl coupled to a ratchet release handle;

an indoor portion having a sliding base configured to slide within said indoor slide base in a first direction perpendicular to the sill of a window; said sliding base further comprising a first leg and a second leg, wherein said first leg further comprises ratchet teeth configured to engage with said pawl;

an outdoor portion configured to slide within said base in a second direction perpendicular to the sill of a window; wherein said indoor portion and said outdoor portion can occupy a retracted position and an extended position with respect to said base.

2. The adjustable bracket of claim 1, wherein said ratchet release handle further comprises a spring.

3. The adjustable bracket of claim 2, wherein said pawl further comprises a body and a free end.

4. The adjustable bracket of claim 3, wherein said ratchet release handle is coupled to said pawl via a connecting rod.

5. The adjustable bracket of claim 4, wherein each of said ratchet teeth further comprise a first surface and a second surface, said first surface and second surface forming a ridge at a free end of said ratchet teeth and forming a valley at a base end of said ratchet teeth.

6. The adjustable bracket of claim 5, wherein said free end of said pawl can occupy a locked position and an unlocked position, wherein in said locked position said free end resides in said valley and abuts said first surface of said ratchet teeth, and in said unlocked position said free end is not in contact with said ratchet teeth.

7. The adjustable bracket of claim 6, wherein said spring has a spring bias force that biases said pawl into said locked position.

8. The adjustable bracket of claim 7, wherein said unlocked position occurs when a force is applied to said ratchet release handle acting against said spring bias force.

9. The adjustable bracket of claim 7, wherein said indoor portion is movable from said extended position to said retracted position by pushing said sliding base toward said base, but said indoor portion is movable from said retracted position to said extended position only by applying a force to said ratchet release handle opposing said spring bias force.

10. The adjustable bracket of claim 5, wherein said pawl further includes a first pawl and a second pawl, wherein said first pawl is situated at a first side of said indoor slide base and said second pawl is situated at a second side of said indoor slide base.

11. The adjustable bracket of claim 10, wherein said ratchet teeth further comprises a first set of ratchet teeth and a second set of ratchet teeth.

12. The adjustable bracket of claim 11, wherein said first set of ratchet teeth are configured to couple with said first pawl and wherein said second set of ratchet teeth are configured to couple with said second pawl.

13. The adjustable bracket of claim 12, wherein said ratchet release handle is coupled to said first pawl and said second pawl via said connecting rod.

14. The adjustable bracket of claim 13, wherein said indoor portion is movable from said extended position to said retracted position by pushing said sliding base toward said base, but said indoor portion is movable from said retracted position to said extended position only by applying a force to said ratchet release handle opposing said spring bias force.

15. The adjustable bracket of claim 1, wherein said outdoor portion further comprises complementary ratchet teeth and pawls configured to allow said outdoor portion to be movable from said extended position to said retracted position by pushing said outdoor portion toward said base, but configured to allow said outdoor portion to be movable from said retracted position to said extended position only by applying decoupling said pawls from said ratchet teeth.

* * * * *